US010758001B2

(12) United States Patent
Case et al.

(10) Patent No.: US 10,758,001 B2
(45) Date of Patent: Sep. 1, 2020

(54) ENERGY RETURN FOOTWEAR PLATE

(71) Applicant: NIKE, Inc., Beaverton, OR (US)

(72) Inventors: Patrick Case, Portland, OR (US); Geng Luo, Portland, OR (US); Tetsuya T. Minami, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 177 days.

(21) Appl. No.: 15/833,504

(22) Filed: Dec. 6, 2017

(65) Prior Publication Data

US 2018/0168281 A1 Jun. 21, 2018

Related U.S. Application Data

(60) Provisional application No. 62/436,527, filed on Dec. 20, 2016.

(51) Int. Cl.

| | |
|---|---|
| ***A43B 7/24*** | (2006.01) |
| ***A43B 13/12*** | (2006.01) |
| ***A43B 13/02*** | (2006.01) |
| ***A43B 13/18*** | (2006.01) |
| ***A43B 13/10*** | (2006.01) |
| *A43B 17/00* | (2006.01) |
| *A43B 7/14* | (2006.01) |

(52) U.S. Cl.

CPC ..... *A43B 7/24* (2013.01); *A43B 13/026* (2013.01); *A43B 13/10* (2013.01); *A43B 13/12* (2013.01); *A43B 13/125* (2013.01); *A43B 13/183* (2013.01); *A43B 13/185* (2013.01); *A43B 7/141* (2013.01); *A43B 17/006* (2013.01)

(58) Field of Classification Search

CPC ..... A43B 7/24; A43B 7/141; A43B 13/026; A43B 13/10; A43B 13/12; A43B 13/125; A43B 13/183; A43B 13/185

See application file for complete search history.

(56) References Cited

U.S. PATENT DOCUMENTS

| | | | | |
|---|---|---|---|---|
| 324,065 | A * | 8/1885 | Andrews | A43B 21/32 36/37 |
| 2,129,424 | A * | 9/1938 | Jay | A43B 7/142 36/76 R |

(Continued)

FOREIGN PATENT DOCUMENTS

| | | |
|---|---|---|
| DE | 8304226 U1 | 6/1983 |
| EP | 2111770 A1 | 10/2009 |

(Continued)

*Primary Examiner* — Jila M Mohandesi
(74) *Attorney, Agent, or Firm* — Quinn IP Law

(57) ABSTRACT

A sole plate for an article of footwear comprises a plate body having a first side, a second side, an outer perimeter, at least one opening extending through the plate body from the first side to the second side, and an inner perimeter bounding the at least one opening. The plate body is biased to a first orientation of the inner perimeter relative to the outer perimeter. The plate body inverts at the inner perimeter relative to the outer perimeter under a dynamic load applied to the second side. The plate body resiliently returns to the first orientation upon removal of the dynamic load. A sole structure and an article of footwear including the sole plate are disclosed. A method of manufacturing an article of footwear with the sole plate is disclosed.

19 Claims, 11 Drawing Sheets

(56) References Cited

U.S. PATENT DOCUMENTS 4,199,878 A * 4/1980 Wossner ..... A43B 5/12 36/108
4,492,046 A * 1/1985 Kosova ..... A43B 13/183 36/27
4,520,581 A * 6/1985 Irwin ..... A43B 7/28 12/142 N
4,534,124 A * 8/1985 Schnell ..... A43B 13/18 36/114
4,910,884 A * 3/1990 Lindh ..... A43B 13/18 36/27
5,142,797 A * 9/1992 Cole, III ..... A43B 5/00 36/102
5,337,492 A * 8/1994 Anderie ..... A43B 13/181 36/114
5,343,636 A * 9/1994 Sabol ..... A43B 5/18 36/27
5,699,627 A 12/1997 Castro
5,706,589 A 1/1998 Marc
6,860,034 B2 * 3/2005 Schmid ..... A43B 13/181 36/27
6,915,598 B2 * 7/2005 Grisoni ..... A43B 7/141 36/149
7,178,270 B2 2/2007 Hurd et al.
7,266,910 B2 * 9/2007 Ingimundarson .... A43B 13/026 36/178
7,434,337 B2 10/2008 Gibert et al.
8,510,970 B2 * 8/2013 Baum ..... A43B 13/183 36/27
8,984,775 B2 3/2015 Dombrow et al.
9,066,559 B2 * 6/2015 Butler ..... A43B 13/386
9,119,438 B2 9/2015 Auger et al.
2002/0152642 A1 * 10/2002 Chu ..... A43B 13/10 36/113
2003/0221337 A1 * 12/2003 Farys ..... A43B 5/003 36/113
2005/0000115 A1 1/2005 Kimura et al.
2005/0108897 A1 * 5/2005 Aveni ..... A43B 3/0068 36/27
2009/0019729 A1 * 1/2009 Nakano ..... A43B 7/14 36/91
2009/0031584 A1 * 2/2009 Rasmussen ..... A43B 7/24 36/88
2010/0269368 A1 * 10/2010 Nakatsuka ..... A43B 5/06 36/27
2013/0139412 A1 * 6/2013 Auger ..... A43B 1/0009 36/25 R
2014/0059895 A1 * 3/2014 Arciuolo ..... A43B 13/026 36/173
2014/0190042 A1 * 7/2014 Scolari ..... A43B 7/144 36/35 R
2015/0013185 A1 1/2015 Elder et al.
2015/0075033 A1 * 3/2015 Cross ..... A43B 13/122 36/103
2015/0089834 A1 * 4/2015 Baum ..... A43B 13/183 36/27
2015/0107133 A1 4/2015 Ganuza et al.
2015/0173457 A1 6/2015 Saito et al.
2015/0351493 A1 12/2015 Ashcroft et al.
2016/0029741 A1 2/2016 Foxen
2016/0051010 A1 2/2016 Baum et al.
2016/0058122 A1 * 3/2016 Foxen ..... A43B 13/125 36/28
2016/0058123 A1 3/2016 Peyton
2016/0198794 A1 7/2016 Wakeland et al.
2016/0270475 A1 9/2016 Foxen et al.

FOREIGN PATENT DOCUMENTS

EP 2395869 A1 8/2010
EP 2491807 A2 8/2012
WO 2008044353 A1 4/2008

* cited by examiner

ENERGY RETURN FOOTWEAR PLATE

CROSS-REFERENCE TO RELATED APPLICATION

This application claims the benefit of priority to U.S. Application No. 62/436,527 filed Dec. 20, 2016, which is hereby incorporated by reference in its entirety.

TECHNICAL FIELD

The present teachings generally include a sole plate for an article of footwear.

BACKGROUND

Footwear typically includes a sole assembly configured to be located under a wearer's foot to space the foot away from the ground. Sole assemblies in athletic footwear may typically be configured to provide one or more of cushioning, motion control, and resiliency.

DESCRIPTION

Figure 1:
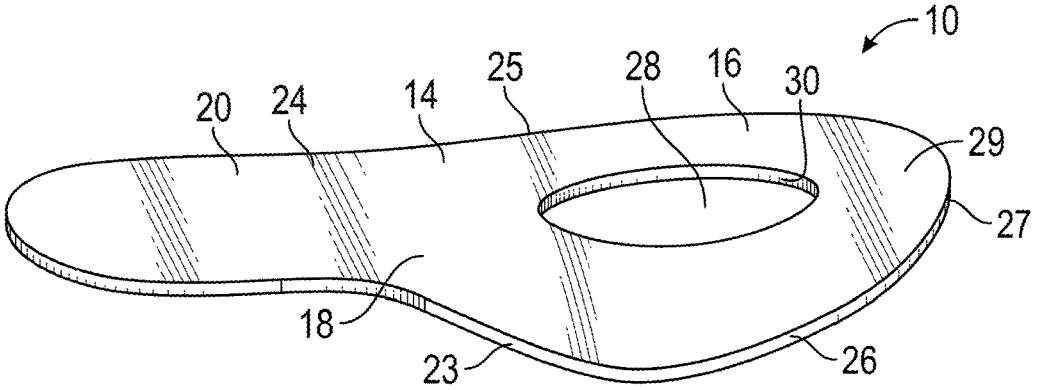
FIG. 1 is a schematic illustration in perspective view of a top side of a first embodiment of an energy return sole plate for an article of footwear in a first orientation.

A sole plate for an article of footwear comprises a plate body having a first side, a second side, an outer perimeter, at least one opening extending through the plate body from the first side to the second side, and an inner perimeter bounding the at least one opening. The plate body is biased to a first orientation of the inner perimeter relative to the outer perimeter. The plate body inverts at the inner perimeter relative to the outer perimeter under a dynamic load applied to the second side, storing elastic energy. The plate body resiliently returns to the first orientation upon removal of the dynamic load, releasing the stored energy. In addition, the return of the plate body to the first orientation is rapid, occurring while the article of footwear is still in contact with the ground, enabling the energy return to be of benefit to propulsion or cushioning. For example, the at least one opening may be in a forefoot region of the plate body, in which case the released elastic energy contributed to propulsion of the foot during toe-off. Alternatively, the at least one opening may be in the heel region of the plate body, in which case the elastic deformation under dynamic load attenuates impact to protect the calcaneus and the ankle, for example.

In an aspect of the disclosure, the first side of the sole plate is concave in the first orientation, and the first side is convex under the dynamic load. In one or more embodiments, the plate body slopes in a first direction from the outer perimeter to the inner perimeter in the first orientation, and the plate body slopes in a second direction opposite from the first direction from the outer perimeter to the inner perimeter under the dynamic load.

In an aspect of the disclosure, the at least one opening comprises a plurality of openings. Alternatively, the at least one opening may be a single opening. Under either alternative, the plate body may include a continuous band extending from a medial side of the plate body to a lateral side of the plate body. The outer perimeter is an outer edge of the continuous band, and the inner perimeter is an inner edge of the continuous band.

In an aspect of the disclosure, the outer perimeter may extend from a medial side of the plate body to a lateral side of the plate body, and the first side of the plate body has an asymmetrical concave curvature with an apex that is offset toward the lateral side or the medial side.

In an aspect of the disclosure, the plate body has a forefoot region, a heel region and a midfoot region disposed between the forefoot region and the heel region. The at least one opening is in the forefoot region, and the heel region of the plate body includes a flange extending from a medial side of the plate body to a lateral side of the plate body.

In an aspect of the disclosure, the plate body comprises any one of carbon fiber, spring steel, fiberglass, nylon, a polyether block amide, or a superelastic metal including nitinol.

A sole structure for an article of footwear comprises a sole plate having a forefoot region, a lower side, an upper side, an outer perimeter, at least one opening extending through the sole plate from the lower side to the upper side in the forefoot region, and an inner perimeter bounding the at least one opening. The sole plate is biased to a first orientation in which the inner perimeter is raised relative to the outer perimeter. A sole layer overlies the upper side of the sole plate. The sole layer transmits an applied dynamic load to the upper side of the sole plate, resiliently deforming the sole plate to a second orientation in which the inner perimeter is below the outer perimeter under the dynamic load. The sole plate resiliently returns to the first orientation upon removal of the dynamic load.

In an aspect of the disclosure, the sole layer has a forefoot region, a heel region, and a midfoot region disposed between the forefoot region of the sole layer and the heel region of the sole layer. The sole plate and the sole layer are fixed to one another in at least one of the heel region of the sole layer and the midfoot region of the sole layer, and the forefoot region of the sole layer is moveable relative to the forefoot region of the sole plate.

In an aspect of the disclosure, the sole plate has a heel region, and a midfoot region disposed between the forefoot region of the sole plate and the heel region of the sole plate. The heel region of the sole plate includes a flange extending upward at a rear of the sole plate from a medial side of the sole plate to a lateral side of the sole plate. The flange may be secured to a footwear upper.

In an aspect of the disclosure, the sole plate slopes upward from the outer perimeter to the inner perimeter in the first orientation, and slopes downward from the outer perimeter to the inner perimeter in the second orientation when under the dynamic load.

In an aspect of the disclosure, the outer perimeter extends around a front of the sole plate from a medial side of the sole plate to a lateral side of the sole plate, and the lower side of the sole plate has an asymmetrical concave curvature with an apex that is transversely offset toward the lateral side or the medial side.

In an aspect of the disclosure, the sole plate has a continuous band extending along a front of the sole plate from a medial side of the sole plate to a lateral side of the sole plate in the forefoot region. The outer perimeter is an outer edge of the continuous band. The inner perimeter is an inner edge of the continuous band.

In an aspect of the disclosure, the lower side of the sole plate is concave in the forefoot region in a transverse direction of the sole plate in the first orientation. The lower side of the sole plate is convex in the forefoot region in the transverse direction under the dynamic load.

In an aspect of the disclosure, the sole plate has a forward extremity that extends forward beyond the sole layer. The sole layer transmits an applied dynamic load to the upper side of the sole plate such that the sole plate bends in the longitudinal direction under the dynamic load, thereby decreasing the curvature of the sole plate and extending the forward extremity of the sole plate further forward relative to the sole layer.

In an aspect of the disclosure, the sole structure further comprises an outsole secured to the lower side of the sole plate. The outsole may include a plate with tread elements such as cleats extending from a lower side of the plate, or the outsole may be cleats or one or more discrete outsole elements secured directly to the sole plate.

An article of footwear comprises a sole plate having a lower side, an upper side, an outer perimeter, at least one opening extending through the sole plate from the lower side to the upper side, and an inner perimeter bounding the at least one opening. The sole plate is biased to a first orientation in which the inner perimeter is raised relative to the outer perimeter. A sole layer overlies the upper side of the sole plate and has a foot-facing surface. A footwear upper is secured to the sole layer to secure a foot in position above the foot-facing surface. The sole layer transmits a dynamic load applied on the foot-facing surface to the upper side of the sole plate, resiliently deforming the sole plate to a second orientation in which the inner perimeter displaces to below the outer perimeter under the dynamic load. The sole plate resiliently returns to the first orientation upon removal of the dynamic load. The return of the sole plate to the first orientation is rapid, occurring while the article of footwear is still in contact with the ground, enabling the energy return to be of benefit to propulsion or cushioning.

In an aspect of the disclosure, the sole layer has a forefoot region, a heel region, and a midfoot region disposed between the forefoot region of the sole layer and the heel region of the sole layer. The at least one opening is in the forefoot region, and the sole plate and the sole layer are fixed to one another in at least one of the heel region of the sole layer and the midfoot region of the sole layer. The forefoot region of the sole layer is moveable relative to the forefoot region of the sole plate.

In an aspect of the disclosure, the sole plate has a forefoot region, a heel region, and a midfoot region disposed between the forefoot region of the sole plate and the heel region of the sole plate. The heel region of the sole plate includes a flange extending upward at a rear of the sole plate from a medial side of the sole plate to a lateral side of the sole plate.

In an aspect of the disclosure, the sole layer is one of a footbed plate or a foam midsole layer. In an aspect of the disclosure, the sole plate slopes upward from the outer perimeter to the inner perimeter in the first orientation, and slopes downward from the outer perimeter to the inner perimeter in the second orientation when under the dynamic load.

In an aspect of the disclosure, the outer perimeter extends around a front of the sole plate from a medial side of the sole plate to a lateral side of the sole plate. The lower side of the sole plate has an asymmetrical concave curvature with an apex that is transversely offset toward the lateral side or the medial side.

In an aspect of the disclosure, the sole plate has a continuous band extending along a front of the sole plate from a medial side of the sole plate to a lateral side of the sole plate. The outer perimeter is an outer edge of the continuous band. The inner perimeter is an inner edge of the continuous band. The lower side of the sole plate is concave in a transverse direction of the sole plate in the first orientation. The lower side of the sole plate is convex in the transverse direction under the dynamic load.

In an aspect of the disclosure, the sole plate has a forward extremity that extends forward beyond the sole layer in the first orientation. The sole layer transmits the applied dynamic load to the upper side of the sole plate such that the sole plate bends in the longitudinal direction under the dynamic load, thereby decreasing a curvature of the sole plate and extending the forward extremity of the sole plate further forward relative to the sole layer in the second orientation than in the first orientation.

In an aspect of the disclosure, the article of footwear further comprises an outsole secured to the lower side of the sole plate. The outsole may include a plate with tread elements such as cleats extending from a lower side of the plate, or the outsole may be cleats or one or more discrete outsole elements secured directly to the sole plate.

A method of manufacturing an article of footwear comprises providing a sole plate that includes a plate body, a first side, a second side, an outer perimeter, at least one opening extending through the plate body from the first side to the second side, and an inner perimeter bounding the at least one opening. The plate body is biased to a first orientation of the inner perimeter relative to the outer perimeter. The plate body inverts at the inner perimeter relative to the outer perimeter to a second orientation when under a dynamic load applied to the second side. The plate body resiliently returns to the first orientation upon removal of the dynamic load. The return of the plate body to the first orientation is rapid, occurring while the article of footwear is still in contact with the ground, enabling the energy return to be of benefit to propulsion or cushioning.

In an aspect of the disclosure, providing the sole plate comprises molding the sole plate by one of compression molding or injection molding. Molding the sole plate may provide the at least one opening.

In an alternative aspect of the disclosure, providing the sole plate comprises stamping the sole plate from a sheet of a material larger than the sole plate. Stamping the sole plate may provide the at least one opening.

In an aspect of the disclosure, forming the at least one opening in the sole plate may be by cutting away a portion of the sole plate. In an aspect of the disclosure, the method may comprise securing an outsole to the lower side of the sole plate.

For consistency and convenience, directional adjectives are employed throughout this detailed description corresponding to the illustrated embodiments. The term "longitudinal" as used throughout this disclosure refers to a direction extending a length of a component (e.g., an upper or sole structure). In some cases, the longitudinal direction may extend from a forefoot portion to a heel portion of the component. Also, the term "laterally" or "transversely" as used throughout this disclosure refers to a direction extending along a width of a component. In other words, the lateral direction may extend between a medial side and a lateral side of a component. Furthermore, the term "vertical" as used throughout this disclosure refers to a direction generally perpendicular to a lateral and longitudinal direction. For example, in cases where an article is planted flat on a level ground surface, the vertical direction may extend from the ground surface upward. Additionally, the term "inner" refers to a portion of a component disposed closer to an interior of the component, or closer to a foot when the component is assembled in an article of footwear worn on the foot. Likewise, the term "outer" refers to a portion of a component disposed farther from the interior of the component or from the foot. Thus, for example, the inner surface of a component is disposed closer to an interior of the component than the outer surface of the component. This detailed description makes use of these directional adjectives in describing an article and various components of the article, including an upper, a sole structure and/or a sole plate. The term "forward" is used to refer to the general direction from a heel portion toward a forefoot portion, and the term "rearward" is used to refer to the opposite direction, i.e., the direction from the forefoot portion toward the heel portion. The term "anterior" is used to refer to a front or forward component or portion of a component. The term "posterior" is used to refer to a rear or rearward component of portion of a component.

The above features and advantages and other features and advantages of the present teachings are readily apparent from the following detailed description of the best modes for carrying out the present teachings when taken in connection with the accompanying drawings.

Figure 10:
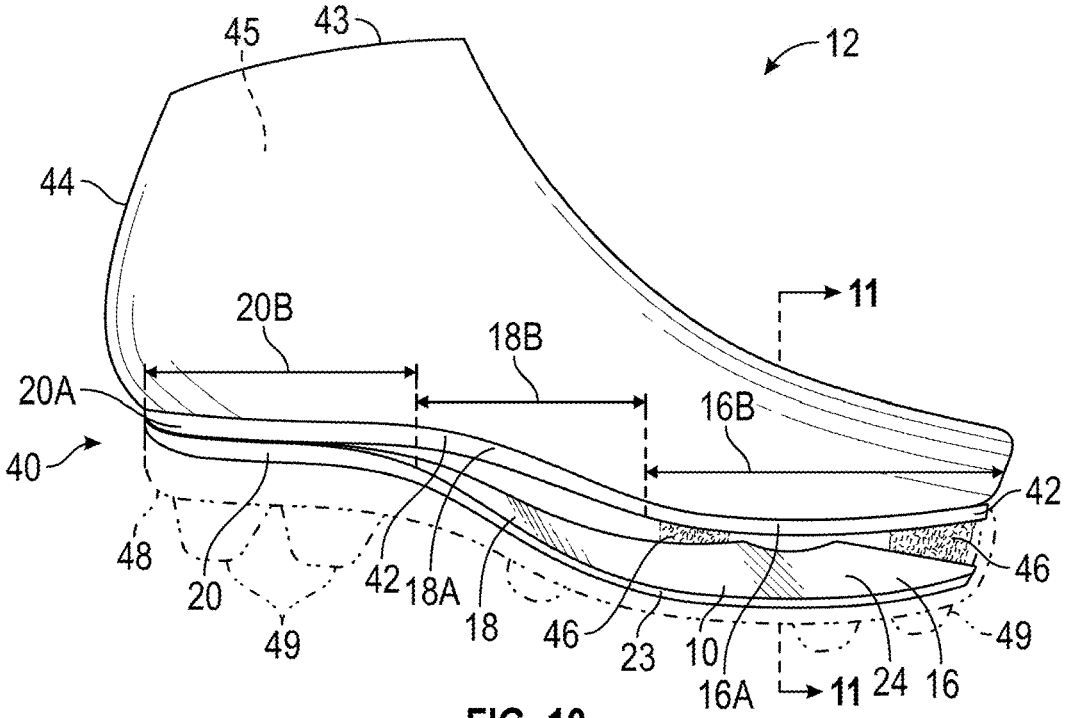
FIG. 10 is a schematic illustration in perspective view of an article of footwear including the energy return sole plate of FIG. 1 in a first orientation.

Referring to the drawings, wherein like reference numbers refer to like components throughout the views, FIG. 1 shows an embodiment of a sole plate 10 for an article of footwear 12, such as the article of footwear 12 of FIG. 10. The sole plate 10 and other sole plates 210, 310, 410, 510, 610, 910, 1010, and 1110 described herein are configured to return energy to the foot during a stride. More specifically, the sole plates described herein are biased to a first orientation, and invert to a second orientation when under a dynamic load storing elastic energy, but resiliently return to the first orientation when the dynamic load is removed, releasing the stored elastic energy (which may be referred to herein as spring energy).

As used herein, the term "plate", such as in sole plate, refers to a member of a sole structure that is generally horizontally disposed when assembled in an article of footwear that is resting on the sole structure on a level ground surface, and is generally used to provide structure and form rather than cushioning. A plate need not be a single component but instead can be multiple interconnected components. Portions of a plate can be flat, and portions can be pre-formed with some amount of curvature and variations in thickness when molded or otherwise formed in order to provide a shaped footbed and/or increased thickness for reinforcement in desired areas.

With reference to FIG. 1, the sole plate 10 has a plate body 14 with a forefoot region 16, and a midfoot region 18, and a heel region 20, and as such is referred to as a full-length sole plate 10. Alternatively, the sole plate 10 could include only a forefoot region 16 or only a forefoot region 16 and midfoot region 18 and still function as described. In other embodiments within the scope of the present disclosure in which an opening as described in the heel region 20 rather than the forefoot region 16, a sole plate could have only a heel region 20, or only a heel region 20 and a midfoot region 18.

The forefoot region 16 generally includes portions of the sole plate 10 corresponding with the toes and the joints connecting the metatarsals with the phalanges of the human foot (interchangeably referred to herein as the "metatarsal-phalangeal joints" or "MPJ" joints). The midfoot region 18 generally includes portions of the sole plate 10 corresponding with an arch area of the human foot, including the navicular joint. The heel region 20 generally includes portions of a sole plate corresponding with rear portions of a human foot, including the calcaneus bone, when the human foot is supported on the sole structure and is a size corresponding with the sole structure. The forefoot region, the midfoot region, and the heel region may also be referred to as a forefoot portion, a midfoot portion, and a heel portion, respectively, and may also be used to refer to corresponding regions of an upper and other components of an article of footwear. The midfoot region 18 is disposed between the forefoot region 16 and a heel region, such as heel region 20, such that the forefoot region 16 is forward of (i.e., anterior to) the midfoot region 18 and the heel region is rearward of (i.e., posterior to) the midfoot region 18.

Figure 2:
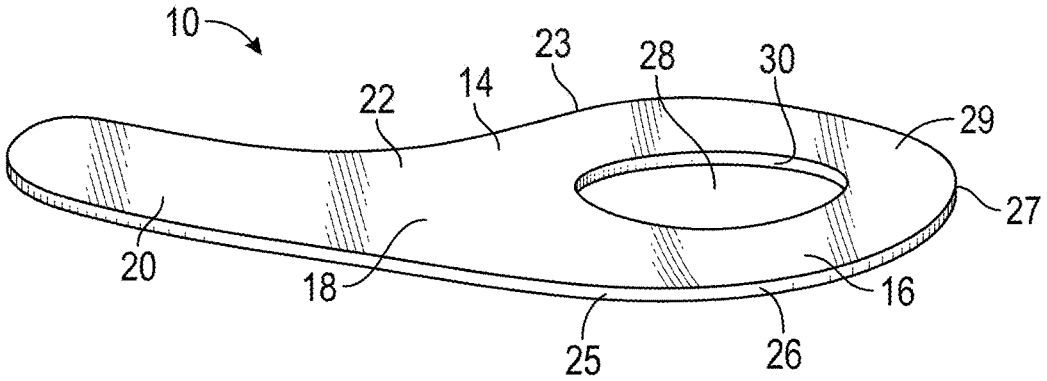
FIG. 2 is a schematic illustration in perspective view of a bottom side of the energy return sole plate of FIG. 1.

The sole plate 10 of FIG. 1 has a first side 22 shown in FIG. 2, also referred to as a lower side 22. The lower side 22 faces away from a foot when a foot is received in the article of footwear. The sole plate 10 has a second side 24 shown in FIG. 1. The second side 24 is also referred to as an upper side 24, and faces toward the foot and is above the lower side 22 when the sole plate 10 is assembled in an article of footwear worn on a foot. The sole plate 10 has a medial side 23 and a lateral side 25. The sole plate 10 of FIGS. 1-4 is a sole plate for a left foot. It should be understood that a sole plate for a right foot is a mirror image of the sole plate 10.

The sole plate 10 has an outer perimeter 26 that extends entirely around the sole plate 10. For example, the outer perimeter 26 extends around a forward portion 27 of the sole plate 10 from the medial side 23 to the lateral side 25. At least one opening 28 extends through the plate body 14 from the first side 22 to the second side 24. Stated differently, the at least one opening 28 passes entirely through the thickness of the sole plate 10. In the embodiment shown, the opening 28 is in the forefoot region 16. Alternatively, the at least one opening 28 may be in the heel region 20 of the plate body 14, in which case the elastic deformation under dynamic load attenuates impact to protect the calcaneus and/or ankle, for example. In the embodiment of FIGS. 1-5, the at least one opening 28 is a single opening. An inner perimeter 30 of the plate body 14 bounds the opening 28. The plate body 14 is formed as a continuous band 29 between the outer perimeter 26 and the inner perimeter 30 at the forefoot portion 16 extending from the medial side 23 of the plate body 14 to the lateral side 25 of the plate body 14 in the forefoot region 16. The outer perimeter 26 is an outer edge of the continuous band 29, and the inner perimeter 30 is an inner edge of the continuous band 29. Stated differently, the sole plate 10 is a continuous closed structure from the inner perimeter 30 to the outer perimeter 26. The plate body 14 passes completely around the opening 28, and continuously bounds the opening and defines the inner perimeter 30 at the opening 28. In other embodiments, the band could be non-continuous.

The plate body 14 is specifically configured so that it is biased to a first orientation of the inner perimeter 30 relative to the outer perimeter 26, with the inner perimeter 30 raised entirely above the outer perimeter 26 in the first orientation. The first orientation is illustrated in FIGS. 1, 3, 4 and 5, and may be referred to as a steady state orientation. The plate body 14 is in the first orientation when it is in an unstressed state and when it is bearing load, but the load is a steady state load less than a predetermined maximum steady state load, such as when the sole plate 10 is supporting the weight of a wearer of an article of footwear, but is not undergoing dynamic loading during a foot stride. Under a dynamic load of sufficient magnitude applied to the upper side 24, the plate body 14 inverts at the inner perimeter 30 relative to the outer perimeter 26 to take on a second orientation, also referred to as a dynamically-loaded or inverted orientation. The second orientation is best shown in FIG. 4. In one non-limiting example, the predetermined maximum steady state load may be 1.5 times a population-average body weight for a foot size to which the article of footwear is dimensioned. Alternatively, the maximum steady state load may be 1.5 times the ninety-ninth percentile body weight of the population for the standard foot size for which the article of footwear is dimensioned. Accordingly, when the athlete is loading his/her whole body weight on one foot, the sole plate 10 will not invert. When the athlete is in motion, the dynamic load may increase above the numerical value of the predetermined maximum steady state load, causing the sole plate 10 to invert to the second orientation.

Figure 3:
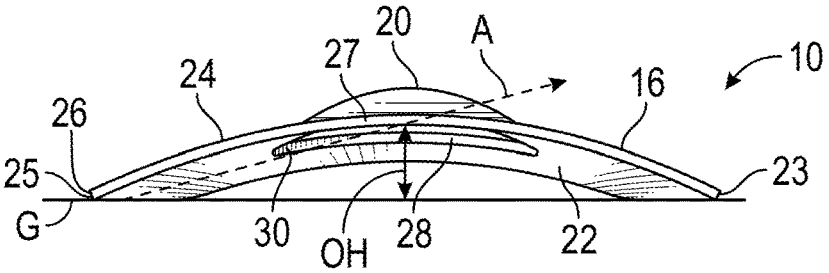
FIG. 3 is a schematic illustration in front view of the energy return sole plate of FIG. 1.
Figure 4:
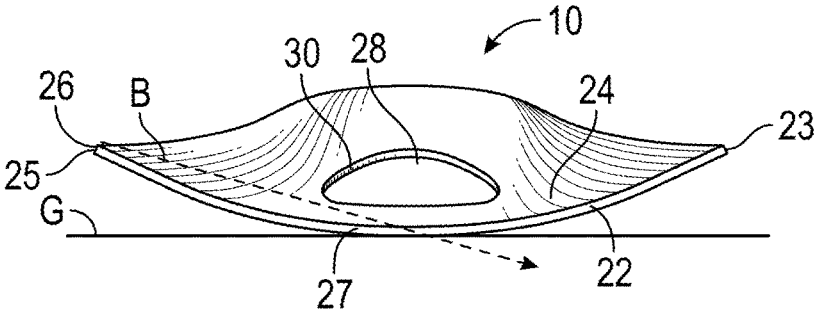
FIG. 4 is a schematic illustration in front view of the energy return sole plate of FIG. 1 inverted under loading.

With reference to FIG. 3, the lower side 22 of the forefoot region 16 is concave in the first orientation, and the upper side 24 is convex in the first orientation. The plate body 14 slopes in a first direction from the outer perimeter 26 to the inner perimeter 30 in the first orientation. The first direction is a direction that has a positive vertical component, as shown in FIG. 3, and may be referred to as a direction with a positive slope from the outer perimeter 26 to the inner perimeter 30 relative to a level ground plane G. Ray A in FIG. 3 extends transversely through the sole plate 10 from the outer perimeter 26 to the inner perimeter 30 and slopes in the first direction. Stated differently, in the first orientation, the inner perimeter 30 is raised relative to the outer perimeter 26. The distance between the top and bottom of the lateral-medial curvature of the sole plate 10 may be referred to as an offset height OH, and is shown in FIG. 3. The offset height OH may be between about 5 millimeters (mm) and 15 mm, such as 5 mm, 6 mm, 7 mm, 8 mm, 9 mm, 10 mm, 11 mm, 12 mm, 13 mm, 14 mm, or 15 mm. Additionally, the size of the opening 28 and the resulting width of the continuous band 29 between the inner perimeter 30 and the outer perimeter 26 affects the ease with which the plate body 14 inverts under the dynamic load (with a wider opening 28 and narrower continuous band 29 promoting inversion relative to a narrower opening 28 and wider continuous band 29). The length of the opening 28 and the length relative to width also affect the ease of inversion. For example, a greater length of the area bounded by the inner perimeter 30 and/or a greater length relative to width of the inner perimeter 30 generally increases ease of inversion. The area bounded by the inner perimeter 26 is the area of the opening 28 in embodiments with a single opening (see, e.g., FIG. 1), and is the area bounding the multiple openings in embodiments having multiple openings as in any of FIG. 8 or 24-26.

The lower side 22 of the forefoot region 16 is convex in the second direction under the dynamic load, and the upper side 24 is concave, as best shown in FIG. 4. The plate body 14 slopes in a second direction opposite from the first direction from the outer perimeter 26 to the inner perimeter 30 in the second orientation when under the dynamic load. The second direction is a direction that has a negative vertical component, as shown in FIG. 4, and may be referred to as a direction with a negative slope from the outer perimeter 26 to the inner perimeter 30 relative to a level ground plane G. Ray B in FIG. 4 extends transversely through the sole plate 10 from the outer perimeter 26 to the inner perimeter 30 and slopes in the second direction. Stated differently, in the second orientation, the outer perimeter 26 is raised relative to the inner perimeter 30.

Inversion of the plate body 14 in this manner causes resilient deformation, which stores elastic energy (also referred to as spring energy). The plate body 14 resiliently returns to the first orientation upon removal of the dynamic load, releasing the stored elastic energy in doing so. The release of the elastic energy urges the plate body 14 back toward the first orientation, moving the inner perimeter 30 relative to the outer perimeter 26 in a direction generally toward the foot supported above the second side 24, urging the desired direction of movement of the foot during toe-off.

In order to be sufficiently biased to the first orientation and to resiliently deform as described, the sole plate 10 has a sufficient thickness between the first and second sides 22, 24, and is of a material that has a sufficient bending stiffness. For example, a carbon fiber plate with a thickness of 0.03-0.05 inches provides desirable energy return under an expected range of dynamic loads produced by a wearer having a population average body weight for a standard footwear size for which the sole plate 10 is designed, and for which the dynamic load may reach, for example, three times the body weight. Non-limiting examples of materials suitable for the sole plate 10 include any one of carbon fiber, spring steel, fiberglass, nylon, a thermoplastic elastomer, such as polyether block amide, or a superelastic metal including nitinol. One example polyether block amide is commercially available under the tradename PEBAX®, from Arkema Inc. in King of Prussia, Pa. USA.

With reference to FIG. 10, the sole plate 10 is shown assembled in the article of footwear 12. When so assembled, the sole plate 10 is included in a sole structure 40 of the article of footwear 12. The sole structure 40 includes a sole layer 42 overlying the upper side 24 of the sole plate 10. The sole layer 42 has a forefoot region 16A, a midfoot region 18A, and a heel region 20A which correspond with the forefoot region 16, midfoot region 18, and heel region 20, respectively, as described with respect to the sole plate 10. These regions are illustrated relative to one another in FIG. 10. The sole layer 42 may be referred to as a footbed plate, as it is positioned between the foot and the sole plate 10 and may have a curved or contoured geometry that may be similar to the lower contours of the foot.

The sole layer 42 may be a compliant, elastic layer, such as a foam layer, to moderate pressure between the foot and the sole plate 10, or may be a plate formed from a more rigid material such as any of the materials described herein as suitable for the sole plate 10. An additional layer, such as an insole, may overlie the sole layer 42 and be positioned between the sole layer 42 and the foot, or the sole layer 42 may directly support the foot. A footwear upper 44 is directly or indirectly secured to the sole layer 42 and forms a foot-receiving cavity 45 or void configured to receive a foot, such as through an ankle opening 43. The upper 44 secures and positions the foot relative to the sole structure 40 and, in the embodiment shown, also includes a forefoot region 16B, a midfoot region 18B, and a heel region 20B.

The sole plate 10 and the sole layer 42 are fixed to one another in at least one of the heel region 20 and the midfoot region 18 of the sole layer 42. In the embodiment of FIG. 10, the sole layer 42 is fixed to the sole plate 10 only in the heel region 20. The heel region 20A of the sole layer 42 is secured to the heel region 20 of the sole plate 10. As used herein, the sole plate 10 and the sole layer 42 are fixed to one another in regions where relative movement is not permitted. For example, the sole plate 10 and the sole layer 42 may be secured to one another in the heel region 20, such as by adhesive, thermally bonding, or ultrasonic welding.

The sole plate 10 and the sole layer 42 are connected to one another in the forefoot region 16 of the sole plate 10, but are done so such that the forefoot region 16A of the sole layer 42 is moveable relative to the forefoot region 16 of the sole plate 10 over a restricted range of movement. For example, a highly compressible foam or other elastic material 46 can be secured to both a lower side of the sole layer 42 and the upper side 24 of the sole plate 10. The interface of the sole plate 10 and the sole layer 42 in the forefoot region 16 such as via elastic material 46 allows some amount of restricted relative fore-aft motion between the sole plate 10 and the sole layer 42 in the forefoot region 16, while limiting or preventing side-to-side motion (also referred to as transverse or lateral motion). The relative fore-aft motion occurs during dorsiflexion and resulting bending in the forefoot region 16, 16A of the sole plate 10 and sole layer 42, respectively, which are at different positions relative to the same bend axis, and therefore require some relative fore-aft motion as the sole plate 10 moves between the first orientation and the second orientation.

The sole structure 40 also includes an outsole 48 secured to and underlying the lower side 22 of the sole plate 10. The outsole 48 may have tread elements 49, such as cleats or spikes that at least partially define a ground-engaging surface. In other embodiments, tread elements or spikes could be directly secured to or formed integrally with the sole plate 10 at the lower side 22. In some embodiments, such as where the article of footwear 12 is a track shoe, the outsole 48 may extend under the sole plate 10 but not under the opening 28.

Figure 11:
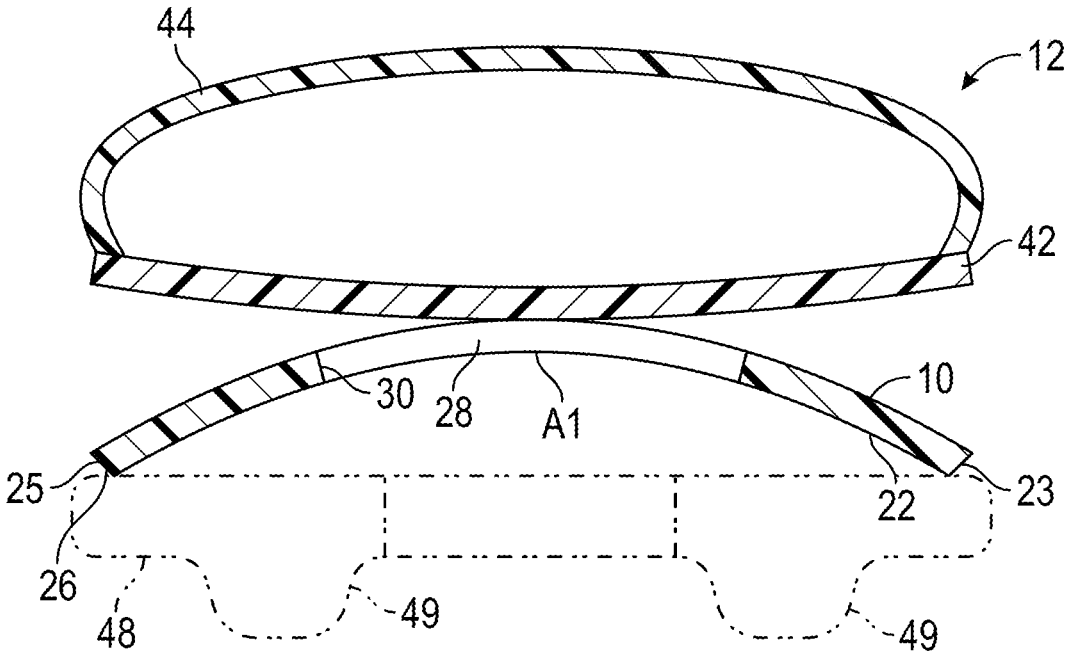
FIG. 11 is a schematic cross-sectional illustration of the article of footwear of FIG. 10 taken at lines 11-11 in FIG. 10.
Figure 12:
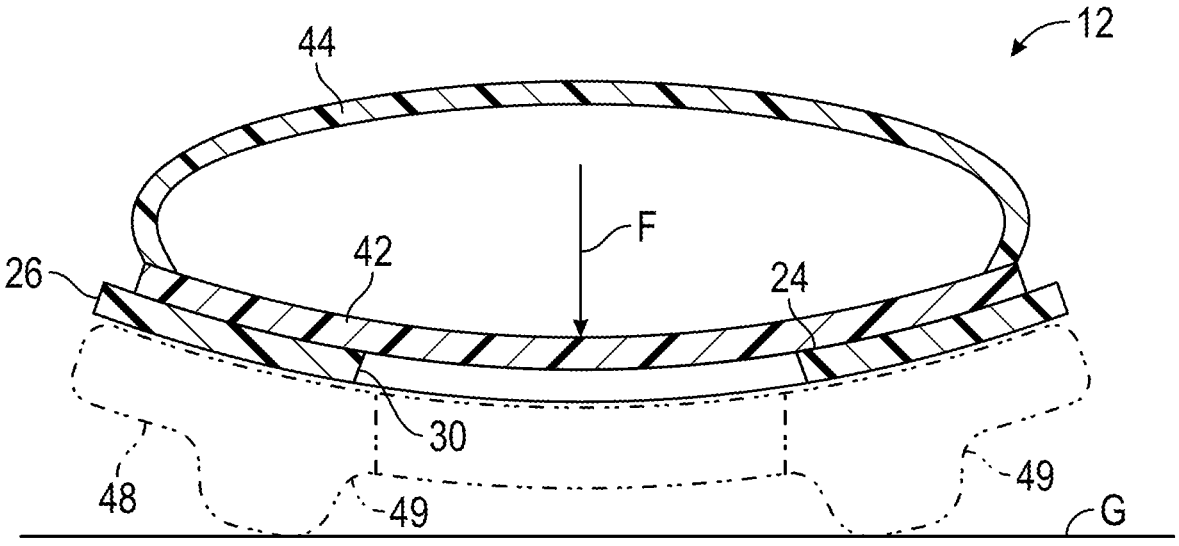
FIG. 12 is a schematic cross-sectional illustration of the article of footwear of FIG. 11 with the sole plate inverted under loading.

FIG. 11 shows the sole plate 10 in the first orientation, such as when the sole structure 40 is under steady-state loading. The sole layer 42 overlies the upper side of the sole plate 10. The concave curvature of the lower side 22 of the sole plate 10 is generally symmetrical between the medial side 23 and the lateral side 25 in the first orientation, with an apex A1 generally centered between the medial side 23 and the lateral side 25. The upper side of the plate body 14 of the sole plate 10 is spaced apart from a lower side of the sole layer 42 between the inner perimeter 30 and the outer perimeter 26 in a transverse direction of the plate body 14 in the first orientation as shown in FIG. 11. The sole layer 42 transmits an applied dynamic load F of the wearer to the upper side 24 of the sole plate 10, resiliently deforming the sole plate 10 to the second orientation shown in FIG. 12 with the inner perimeter 30 inverting relative to the outer perimeter 26 so that the upper side of the plate body 14 abuts the lower side of the sole layer 42 between the inner perimeter 30 and the outer perimeter 26 in the transverse direction of the plate body 14. The loading may occur during a stride when the wearer's weight is substantially shifted to the forefoot region 16, such as during toe-off or when landing on the forefoot region 16 during sprinting or the like. When the dynamic load is removed, the internal bias of the sole plate 10 to its undeformed state causes the sole plate 10 to return to the first orientation of FIG. 11. The sole plate 10 thus "pops" upward (generally in the direction opposite to the force F) at the inner perimeter 30 when returning to the first orientation upon removal of the dynamic load, applying energy on the foot in the upward direction, and thus returning the deformation energy to the foot. The sole plate 10 cyclically moves between the first orientation and the second orientation with repetitive foot strides.

Figure 5:
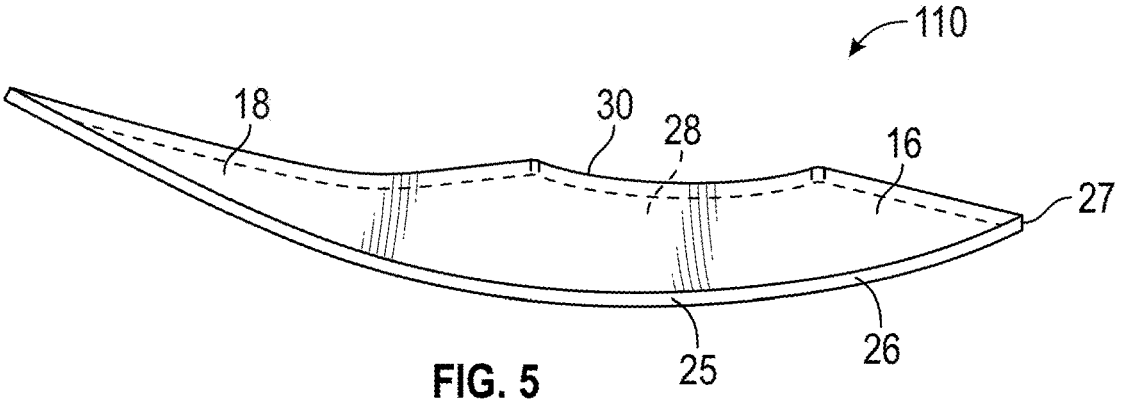
FIG. 5 is a schematic illustration in side view of an alternative embodiment of an energy return sole plate.

FIG. 5 is an alternative embodiment of a sole plate 110 that has identical features as sole plate 10 which are indicated with like reference numbers. Sole plate 110 has a forefoot portion 16 and a midfoot portion 18, but no heel portion. When the sole plate 110 is secured within an article of footwear similar to the position and securement of sole plate 10 in FIG. 10, the midfoot portion 18 of the sole plate 110 is secured to the sole layer 42 such as by adhesive, thermally bonding, or ultrasonic welding. The elastic material 46 can be secured to both a lower side 22 of the sole layer 42 and the upper side 24 of the sole plate 110 as described with respect to sole plate 10 in FIG. 10.

Figure 6:
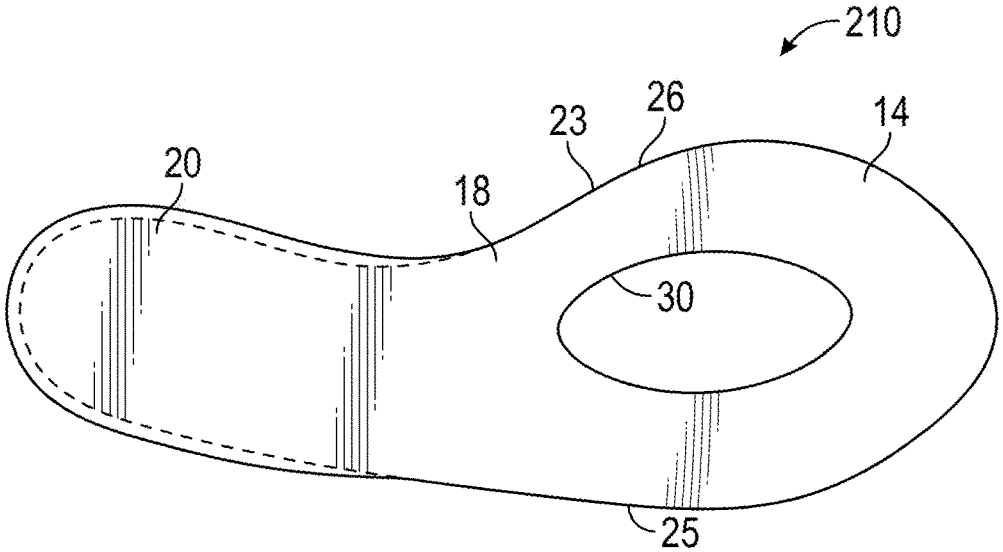
FIG. 6 is a schematic illustration in bottom view of another alternative embodiment of an energy return sole plate.
Figure 7:
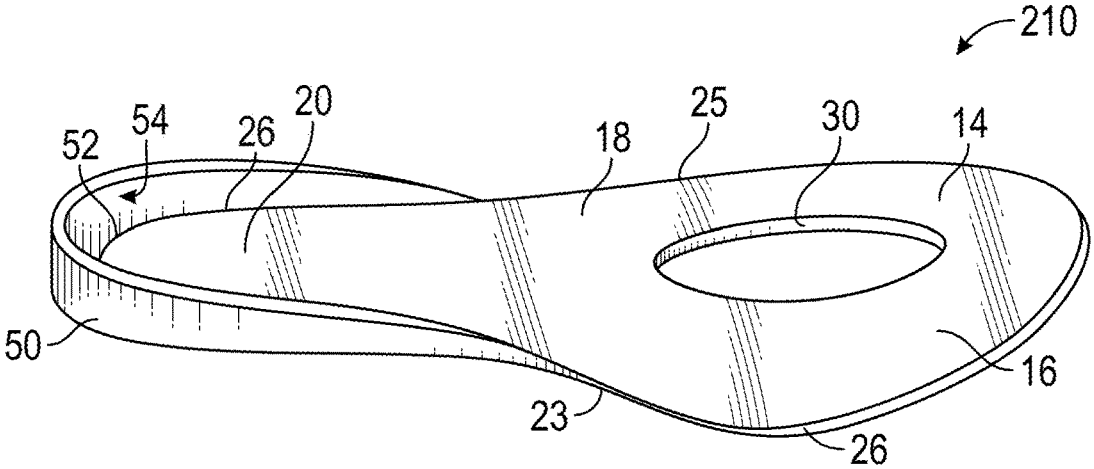
FIG. 7 is a schematic illustration in perspective view of the energy return sole plate of FIG. 6.

FIGS. 6-7 show an embodiment of a sole plate 210 that is configured identically to sole plate 10 of FIG. 1 except that the heel region 20 of the plate body 14 includes a flange 50 extending upward relative to the second side 24 at the outer perimeter 26 and around a rear portion 52 of the sole plate body 14 from the medial side 23 of the plate body 14 to the lateral side 25 of the plate body 14. The flange 50 has an inner surface 54 which in one or more embodiments is secured to an outer surface of the footwear upper 44. If the footwear upper 44 includes a heel counter, the outer surface of the footwear upper 44 to which the flange 50 may be adhered may be the heel counter. Alternatively, the footwear upper 44 may not have a separate heel counter, and the flange 50 may serve as the heel counter. The plate body 14 at the heel region 20 is also secured to the footwear upper 44 as in the embodiment of sole plate 10 shown in FIG. 10.

Figure 8:
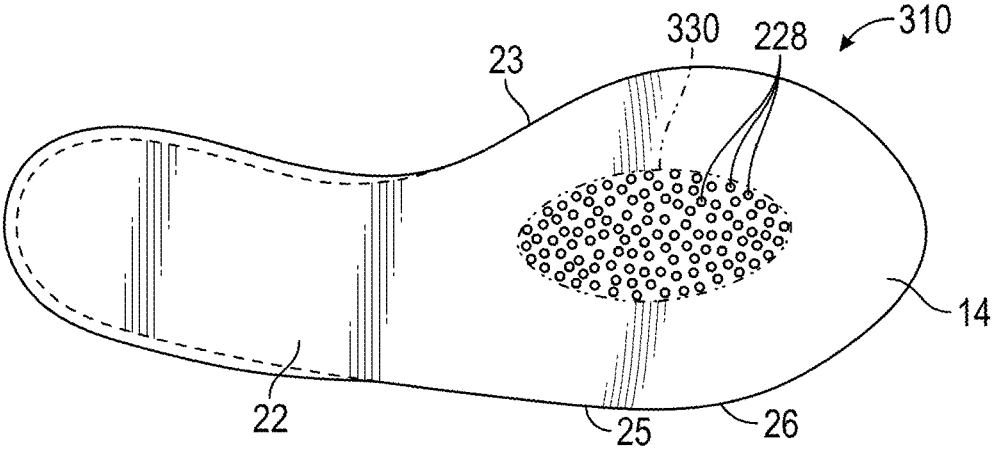
FIG. 8 is a schematic illustration in bottom view of another alternative embodiment of an energy return sole plate.
Figure 9:
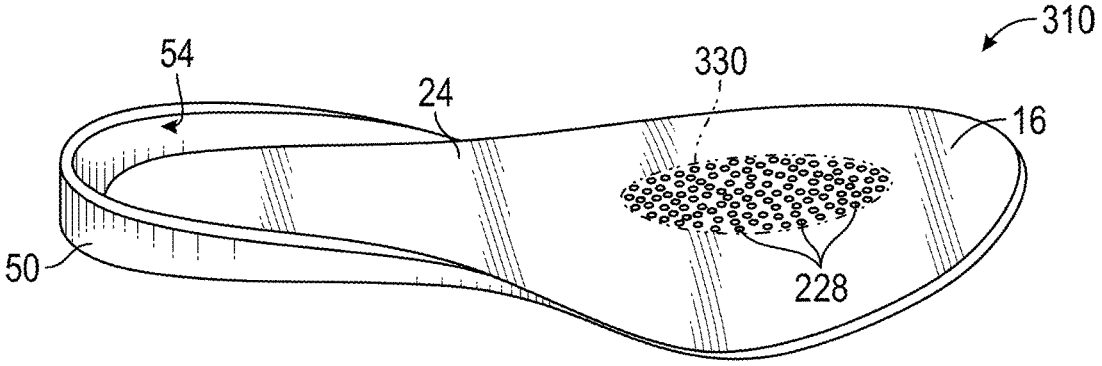
FIG. 9 is a schematic illustration in perspective view of the energy return sole plate of FIG. 8.

FIGS. 8-9 show an embodiment of a sole plate 310 that is configured identically to sole plate 210 of FIGS. 6-7 except that a plurality of openings 228 (instead of a single opening 28) extend through the plate body 14 of the sole plate 310 from the top side 24 to the bottom side 22 instead of a single opening 28. The plurality of openings 228 are clustered together and are bounded by a perimeter 330 indicated in phantom. The clustered openings 228 lessen the material of the plate body 14 bounded by the perimeter 330 sufficiently to cause the perimeter 330 to invert relative to the outer perimeter 26 under dynamic loading as described with respect to the inner perimeter of the sole plate 10 of FIG. 1. In another embodiment, the opening 28 of FIG. 1 could be filled with an elastic material that flexes and stretches during movement of the perimeter 330 relative to the outer perimeter 26 as the sole plate 310 moves from the first orientation to the second orientation or from the second orientation to the first orientation.

Figure 26:
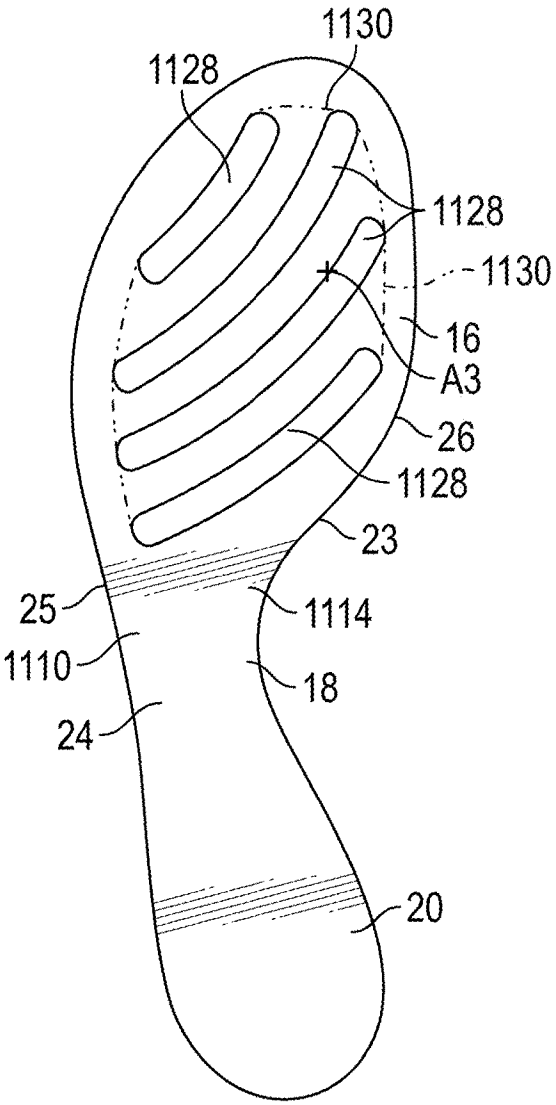
FIG. 26 is a schematic illustration in plan view of an alternative embodiment of an energy return sole plate.
Figure 25:
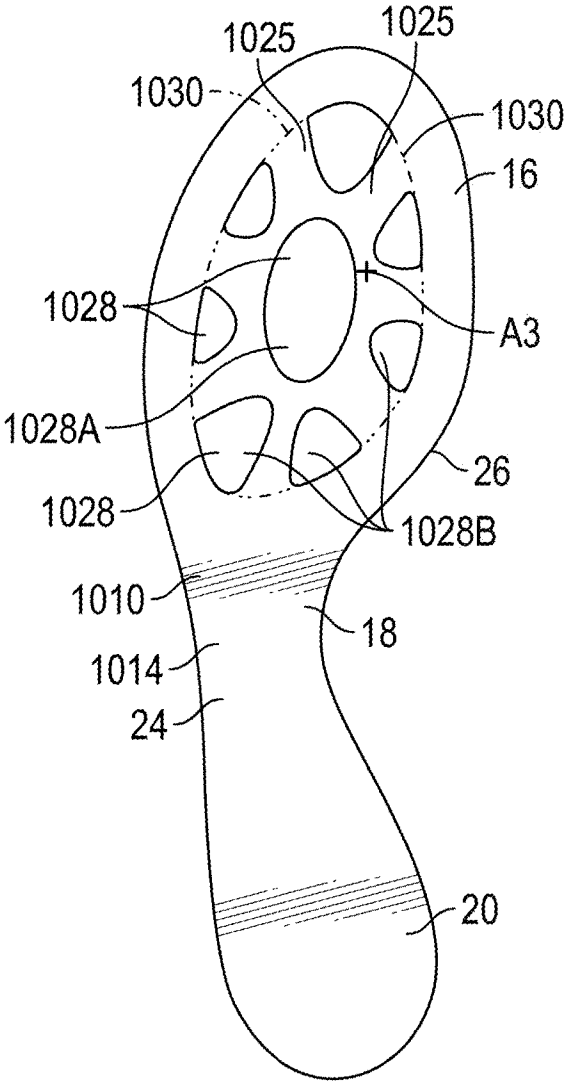
FIG. 25 is a schematic illustration in plan view of an alternative embodiment of an energy return sole plate.
Figure 24:
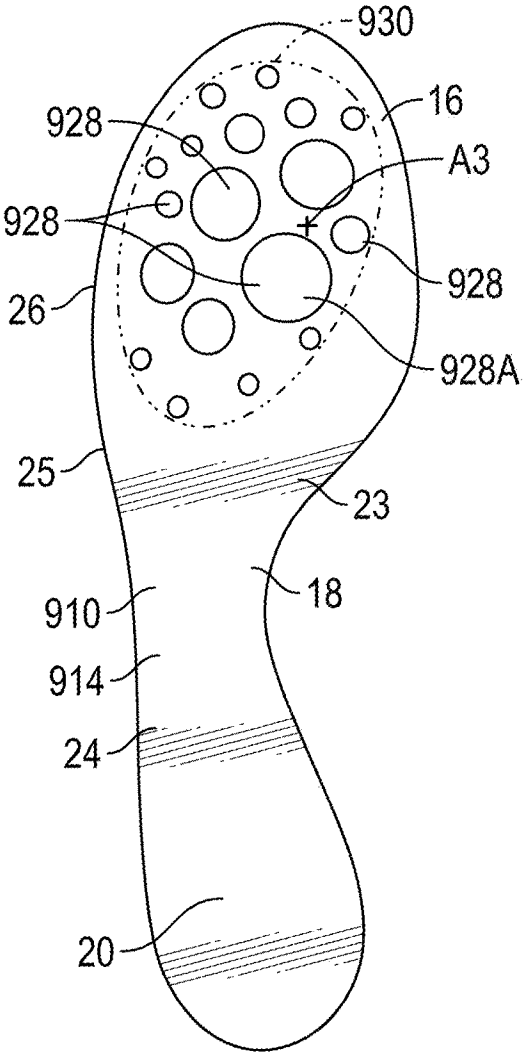
FIG. 24 is a schematic illustration in plan view of an alternative embodiment of an energy return sole plate.

FIGS. 24-26 illustrate embodiments of sole plates 910, 1010, and 1110, each of which is configured identically to sole plate 210 of FIGS. 6-7 except that each of these embodiments also has a plurality of openings (instead of a single opening 28). FIG. 24 shows a sole plate 910 with a plate body 914 having a plurality of openings 928 that extend through the forefoot region 16 of the plate body 914 from the top side 24 to the bottom side 22. The plurality of openings 928 are clustered together and are bounded by a perimeter 930 indicated in phantom. The plurality of openings include a variety of differently sized circular openings, with larger circular openings clustered generally in the center of the perimeter 930 and slightly toward the medial side 23. The sole plate 910 inverts from the first orientation shown in FIG. 24 (in which the inner perimeter 930 is displaced above the outer perimeter 26) to the second orientation as shown and described with respect to sole plates 10, 410, and 510, and may have an apex A3 offset toward the medial side 23 as described with respect to sole plate 410 and generally centered under the big toe, where the foot pushes off. The lessening of material is thus focused near the largest opening 928A and the apex A3. When the dynamic load is released, the sole plate 910 returns energy at the apex A3, encouraging the foot in the desired push-off direction.

FIG. 25 shows a sole plate 1010 with a plate body 1014 having a plurality of openings 1028 that extend through the forefoot region 16 of the plate body 1014 from the top side 24 to the bottom side 22. The plurality of openings 1028 include a central opening 1028A and a plurality of peripheral opening 1028B bounding the central opening 1028A. The openings 1028 are bounded by a perimeter 1030 indicated in phantom. The plurality of openings 1028 may be slightly toward the medial side 23. The sole plate 1010 inverts from the first orientation shown in FIG. 25 (in which the inner perimeter 1030 is displaced above the outer perimeter 26) to the second orientation as shown and described with respect to sole plates 10, 410, and 510, and may have an apex A3 offset toward the medial side 23 as described with respect to sole plate 410 and generally centered under the big toe, where the foot pushes off. When the dynamic load is released, the sole plate 1010 returns energy at the apex A3, encouraging the foot in the desired push-off direction. Alternatively, the apex may be centered at the central opening 1028A. In either case, the plate body 1014 creates a webbing 1025 between the openings 1028 the spring effect.

FIG. 26 shows a sole plate 1110 with a plate body 1114 having a plurality of openings 1128 that extend through the forefoot region 16 of the plate body 1114 from the top side 24 to the bottom side 22. The plurality of openings 1128 are arranged as slots extending generally rearward from the medial side 23 to the lateral side 25. The openings 1128 are bounded by a perimeter 1130 indicated in phantom. The sole plate 1110 inverts from the first orientation shown in FIG. 26 (in which the inner perimeter 1130 is displaced above the outer perimeter 26) to the second orientation as shown and described with respect to sole plates 10, 410, and 510, and may have an apex A3 offset toward the medial side 23 as described with respect to sole plate 410 and generally centered under the big toe, where the foot pushes off. When the dynamic load is released, the sole plate 1110 returns energy at the apex A3, encouraging the foot in the desired push-off direction.

In any of the embodiments of sole plates shown and described herein, the sole layer 42 overlying the specific sole plate and/or the outsole 48 disposed adjacent the lower side 22 of the sole plate may be a transparent material so that the specific opening or openings in the plate body are visible there through and provide an aesthetically pleasing quality.

Figure 13:
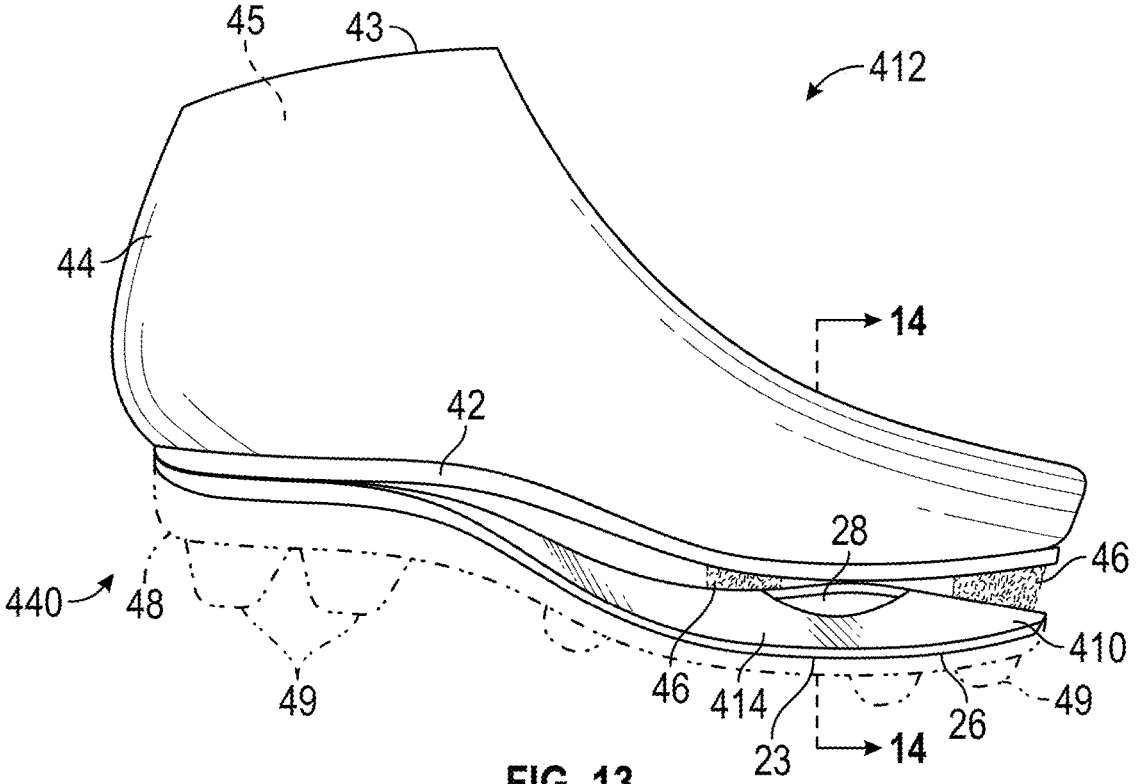
FIG. 13 is a schematic illustration in perspective view of an article of footwear including an alternative embodiment of an energy return sole plate in a first orientation.

FIG. 13 shows an alternative embodiment of an article of footwear 412 that has many of the same components as the article of footwear 12 of FIG. 10, which is referenced with identical reference numbers in FIG. 13. As evident in FIG. 14, the article of footwear 412 includes a sole structure 440 with a plate body 414 that is used in place of plate body 14 in FIG. 10. The plate body 414 has the same features and functions as plate body 14, except that the first side 422 of the plate body 414 has an asymmetrical concave curvature with an apex A2 that is offset toward the medial side 23, instead of a symmetrical concave curvature with a centered apex A1 shown in FIG. 11. The second side 424 has an asymmetrical convex curvature centered at apex A3. The sole layer 42 is tangent to the second side 424 at the apex A3.

Figure 14:
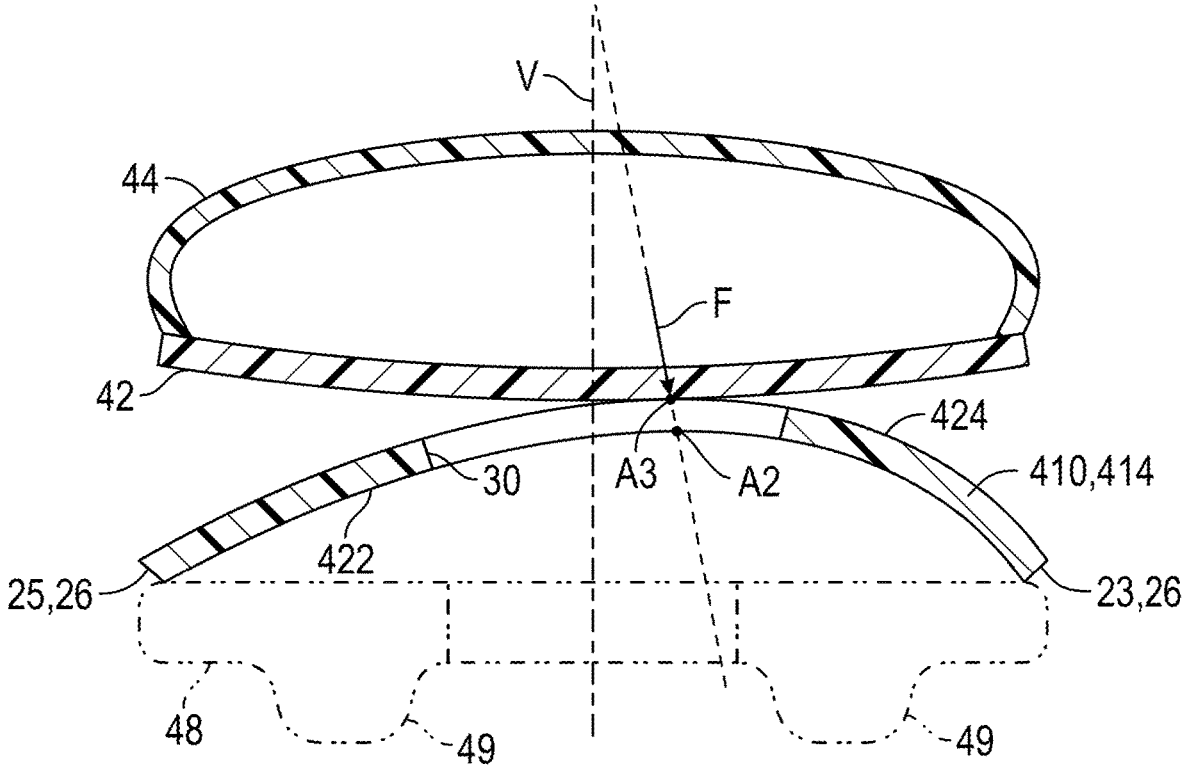
FIG. 14 is a schematic cross-sectional illustration of the article of footwear of FIG. 13 taken at lines 14-14 in FIG. 13.
Figure 15:
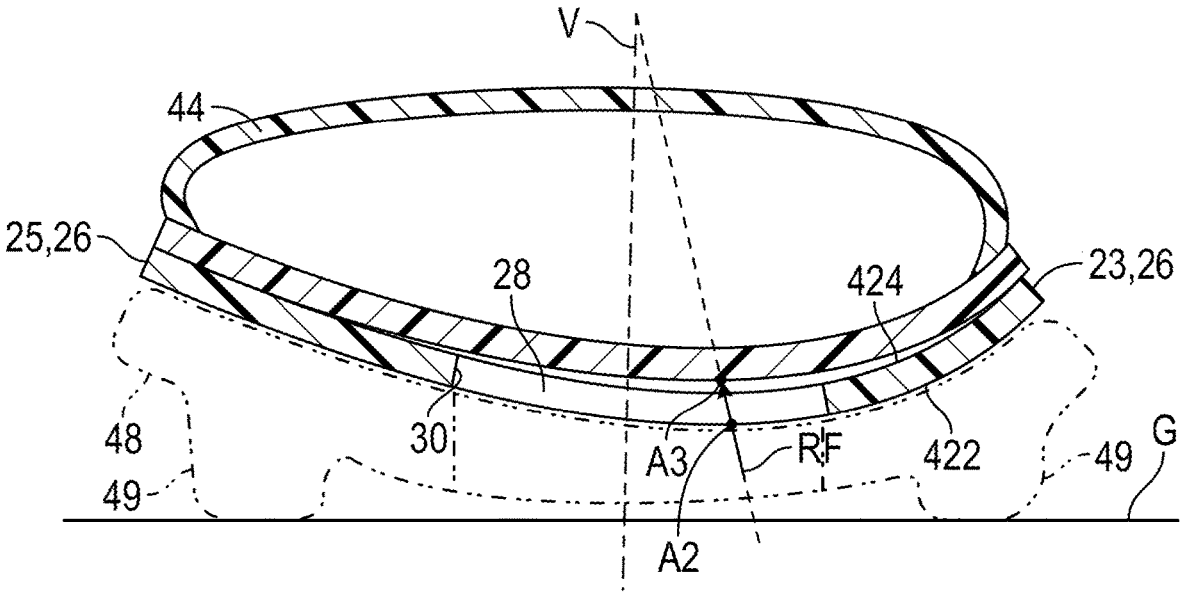
FIG. 15 is a schematic cross-sectional illustration of the article of footwear of FIG. 14 with the sole plate inverted under loading.

A downward dynamic load in the vertical direction V applied on the second side 424 of the sole plate 410 has a component F normal to the plate body 414. For example, the force F may be exerted by an athlete on the sole layer 42 and sole plate 410 during running on a banked track or surface (referred to as "banking"). The force F as shown in FIG. 14 causes the plate body 414 to invert at the inner perimeter 30 relative to the outer perimeter 26, as shown in FIG. 15. The first side 422 has an asymmetrical convex curvature offset toward the medial side 23 in the second orientation of FIG. 15, and the second side 424 has an asymmetrical concave curvature. When the dynamic load F is removed, the plate body 414 resiliently returns to the first orientation. A return force RF of the plate body 414 on the sole layer 42 is normal to the tangent of the plate body 414 and the sole layer 42. The return force RF thus urges the sole layer 42 (and the foot supported on the sole layer 42 within the upper 44) toward the lateral side 25 as is desirable when running on a banked track that slopes upward from the lateral side to the medial side 23 of the article of footwear 412 which is for a left foot.

Figure 16:
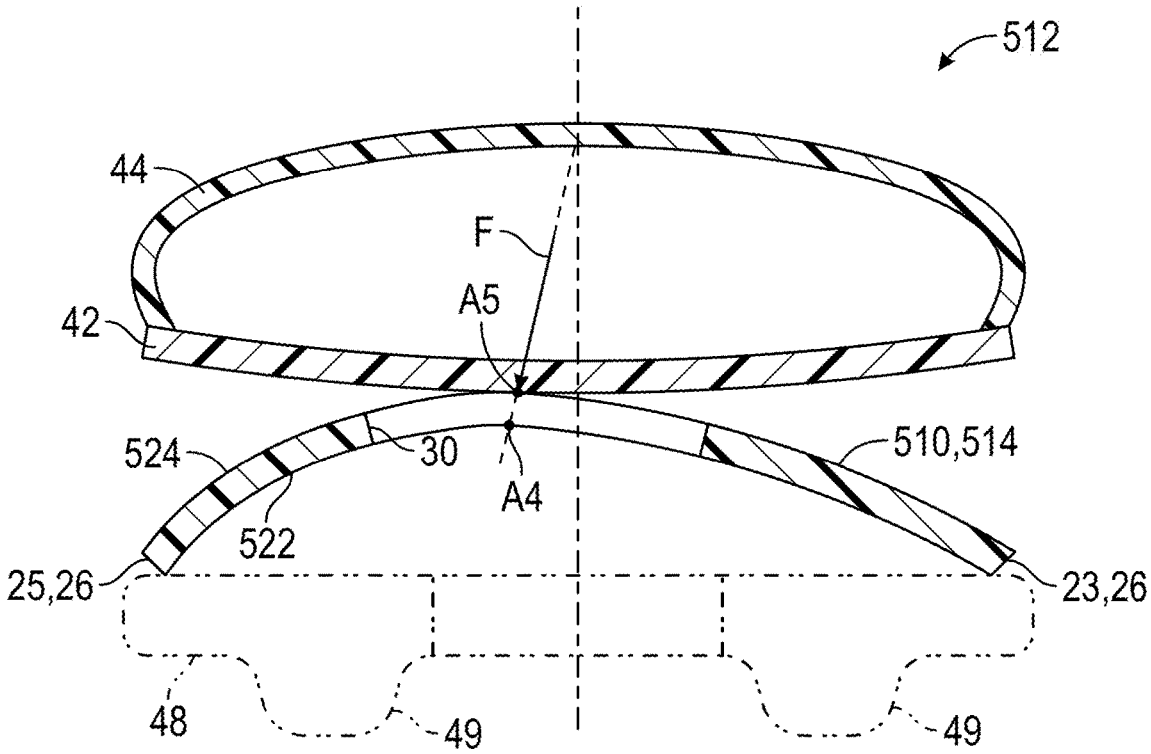
FIG. 16 is a schematic cross-sectional illustration of an article of footwear with an alternative embodiment of an energy return sole plate in a first orientation.

FIG. 16 shows an alternative embodiment of an article of footwear 512 that has many of the same components as the article of footwear 12 of FIG. 10, which is referenced with identical reference numbers in FIG. 13. As evident in FIG. 16, a plate body 514 is used in place of plate body 14 in FIG. 10. A sole plate 510 has a plate body 514 that has the same features and functions as plate body 14, except that the first side 522 of the plate body 514 has an asymmetrical concave curvature with an apex A4 that is offset toward the lateral side 25, instead of a symmetrical concave curvature with a centered apex A1 shown in FIG. 11. The second side 524 has an asymmetrical convex curvature centered at apex A5. The sole layer 42 is tangent to the second side 524 at the apex A5. Similar to plate body 414 of FIG. 14, a dynamic load on the plate body 514 will be returned along a line normal to the sole layer 42 at the apex A5, urging the sole layer 42 upward and slightly toward the medial side 23, as is desirable when running on a banked track that slopes upward from the medial side 23 toward the lateral side 25.

Figure 17:
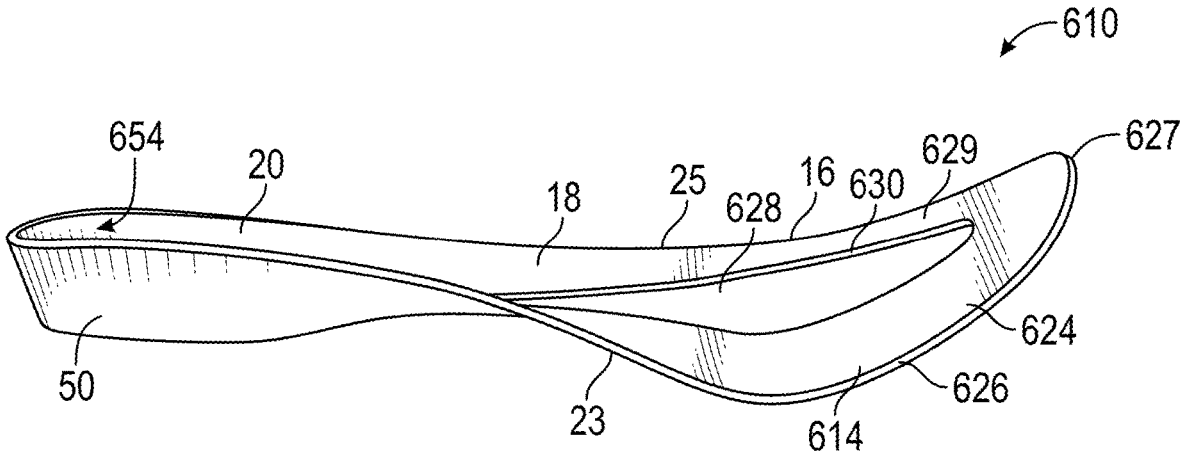
FIG. 17 is a schematic illustration in perspective view of an alternative embodiment of an energy return sole plate in a first orientation.
Figure 18:
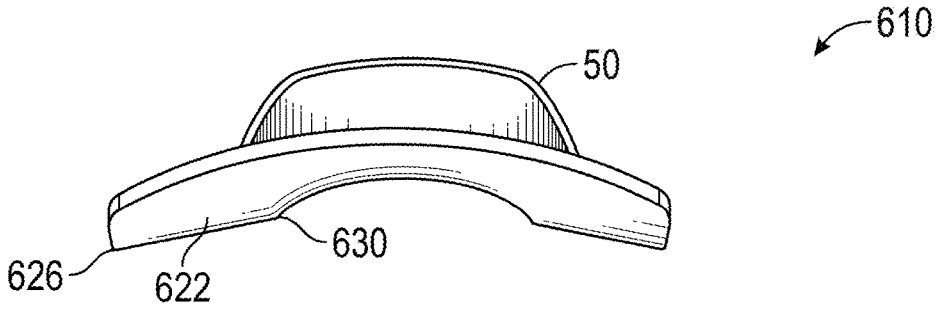
FIG. 18 is a schematic illustration in front view of the energy return sole plate of FIG. 17.
Figure 19:
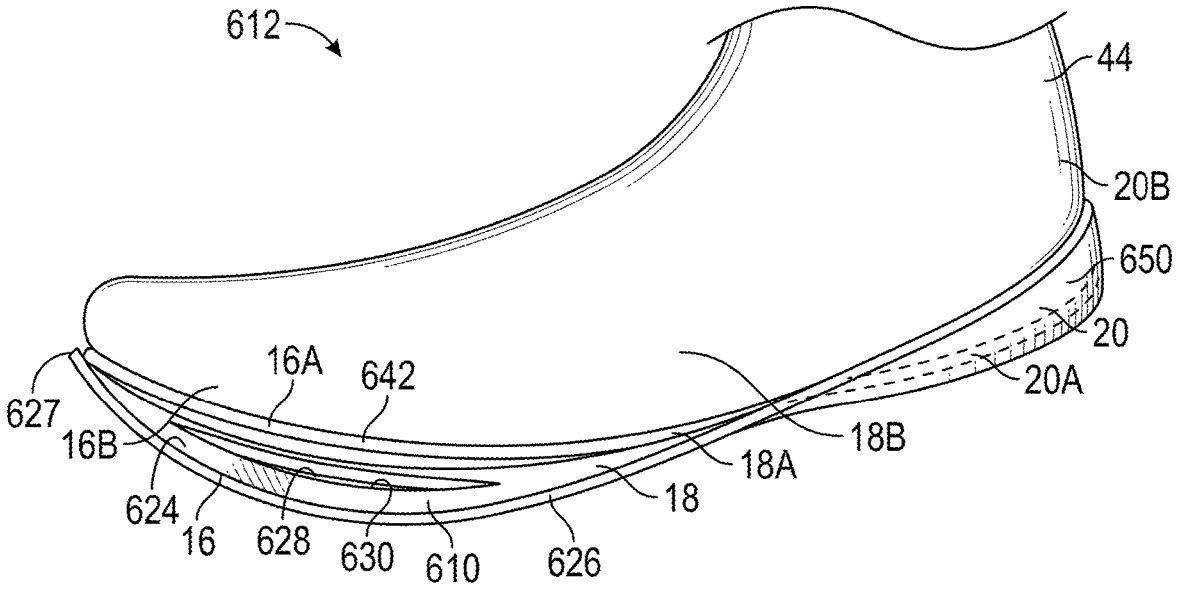
FIG. 19 is a schematic illustration in side view of an article of footwear including the sole plate of FIG. 17 in a first orientation.
Figure 20:
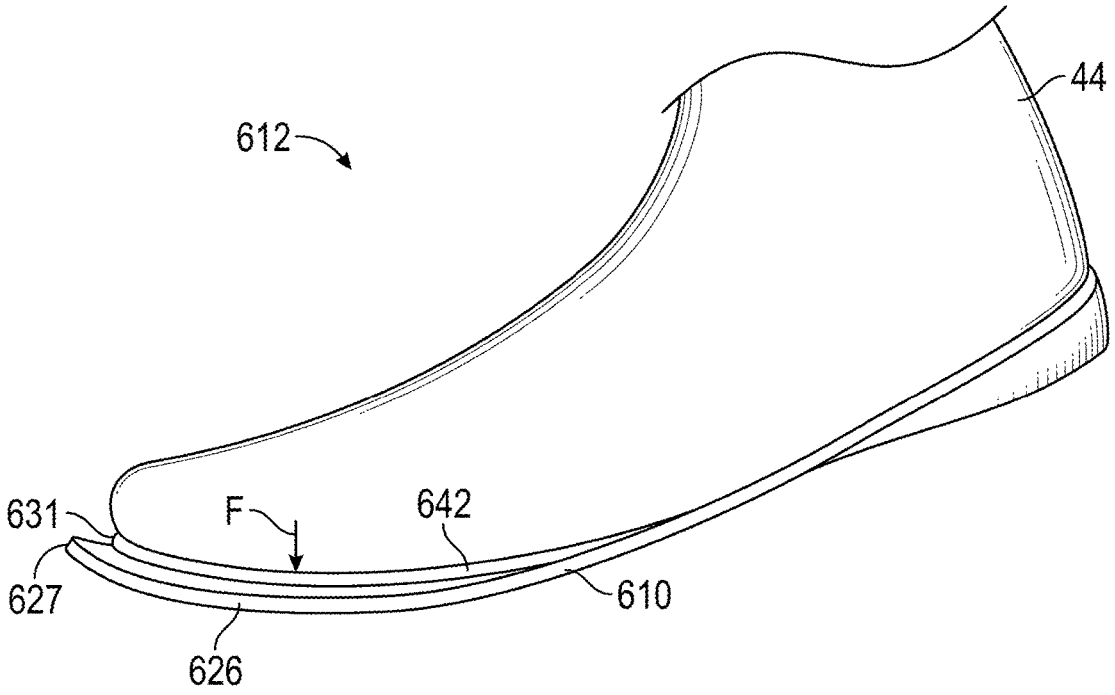
FIG. 20 is a schematic illustration in side view of the article of footwear of FIG. 19 with the energy return sole plate under loading.

FIGS. 17-18 show an alternative embodiment of a sole plate 610 and FIGS. 19-20 show the sole plate 610 assembled in an article of footwear 612. The sole plate 610 has many of the same components and features as the sole plate 10 of FIG. 1, and these are referenced with identical reference numbers. The sole plate 610 has a plate body 614 with a single opening 628 that extends entirely through the forefoot portion 16 from a first side 622 (lower side) to a second side 624 (upper side). An inner perimeter 630 bounds the at least one opening 628. The outer perimeter 626 extends from the medial side 23 of the plate body 614 to the lateral side 25 of the plate body 614. As such, the plate body 614 includes a continuous band 629 extending from the medial side 23 to the lateral side 25. The outer perimeter 626 is an outer edge of the continuous band 629, and the inner perimeter 630 is an inner edge of the continuous band 629.

The sole plate 610 is biased to a first orientation in which the inner perimeter 630 is raised relative to an outer perimeter 626 of the sole plate 610. Stated differently, the sole plate 610 slopes upward from the outer perimeter 626 to the inner perimeter 630 in the first orientation shown in FIG. 18, and slopes downward from the outer perimeter 626 to the inner perimeter 630 in the second orientation when under the dynamic load similar to as shown in FIG. 4 and as indicated in FIG. 20. The lower side 622 of the forefoot region 16 of the sole plate 610 is concave in a transverse direction of the sole plate in the first orientation, and the lower side 622 of the forefoot region 16 of the sole plate 610 is convex in the transverse direction under the dynamic load.

A sole layer 642 overlies the upper side 624 of the sole plate 610. The sole layer 642 may be a footbed plate or a foam midsole layer. The sole layer 642 transmits an applied dynamic load F indicated in FIG. 20 to the upper side 624 of the sole plate, resiliently deforming the sole plate 610 to the second orientation. The sole plate 610 resiliently returns to the first orientation upon removal of the dynamic load. The sole plate 610 and the sole layer 642 are fixed to one another in the heel region 20 such as by adhesive, ultrasonic welding or thermal bonding, and the forefoot region 16A of the sole layer 642 is moveable relative to the forefoot region 16 of the sole plate 610 as indicated by the relative positions in FIGS. 19 and 20.

The heel region of the sole plate 610 includes a flange 650 extending upward at a rear of the sole plate 610 from the medial side 23 to the lateral side 25. The flange 650 extends upward relative to the second side 624 at the outer perimeter 626 and around a rear portion of the sole plate body 614 from the medial side 23 of the plate body 614 to the lateral side 25 of the plate body 614. The flange 650 has an inner surface 654 which in one or more embodiments is secured to an outer surface of the footwear upper 44. If the footwear upper 44 includes a heel counter, the outer surface of the footwear upper 44 to which the flange 650 may be adhered may be the heel counter. Alternatively, the footwear upper 44 may not have a separate heel counter, and the flange 650 may serve as the heel counter.

The forefoot region 16 of the sole plate 610 is able to move relative to the sole layer 642. Elastic material 46 such as shown in FIG. 10 may be used to allow some amount of restricted relative fore-aft motion between the sole plate 610 and the sole layer 642 in the forefoot region 16, while limiting or preventing side-to-side motion. The plate body 614 at the heel region 20 is also secured to the footwear upper 44 as shown in FIG. 19. The heel region 20A, midfoot region 18A, and forefoot region 16A of the sole plate 642 are secured to the footwear upper 44 at the heel region 20B, the midfoot region 18B and the forefoot region 16B, respectively.

As best shown in FIG. 19, the sole plate 610 has a forward extremity 627 that extends forward beyond a forwardmost extent of the sole layer 642. When the sole layer 642 transmits the applied dynamic load to the upper side 624 of the sole plate 610 such that the sole plate 610 bends in the longitudinal direction under the dynamic load, the curvature of the sole plate 610 decreases, as is apparent in FIG. 20 relative to FIG. 19, and the forward extremity 627 of the sole plate 610 is thereby made to extend further forward relative to the sole layer 642.

The added length of the sole plate 610 forward of the sole layer 642 in the loaded position of FIG. 20 adds surface area forward of the sole plate 610 that effectively enables the plate 610 to provide a propulsion surface at the front of the article of footwear 612 equivalent to that of an article of footwear for a much larger size foot, such that the portion of sole plate 610 forward of the sole layer 642 acts as a lever, and the footwear 612 pivots forward about the forwardmost extremity 627 during toe-off rather than pivoting about a forward distal end 631 of the forefoot portion 16A of the sole layer 642.

Figure 21:
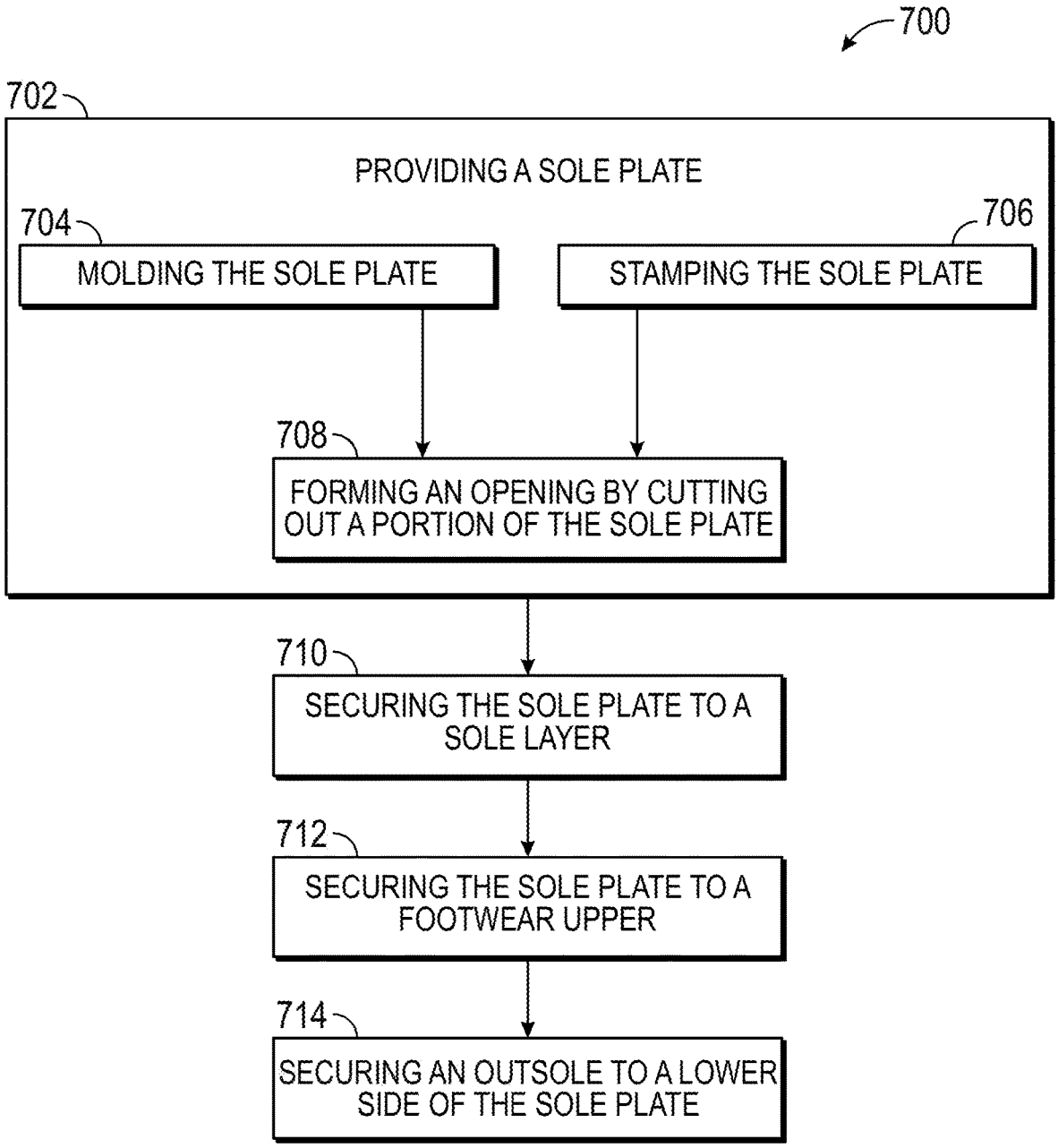
FIG. 21 is a flow diagram of a method of manufacturing an article of footwear.

A method of manufacturing an article of footwear that includes any of the sole plates 10, 110, 210, 310, 410, 510, 610 disclosed herein is schematically depicted in a flow diagram in FIG. 21. The method 700 includes block 702, providing a sole plate 10, 110, 210, 310, 410, 510, 610 any of which includes a plate body having a forefoot region, a first side, a second side, an outer perimeter, at least one opening extending through the plate body from the first side to the second side in the forefoot region, and an inner perimeter bounding the at least one opening, as described. Any such sole plate has a plate body that is biased to a first orientation of the inner perimeter relative to the outer perimeter, inverts at the inner perimeter relative to the outer perimeter to a second orientation when under a dynamic load applied to the second side, and resiliently returns to the first orientation upon removal of the dynamic load, all as described with respect to the plate bodies 14, 414, 514, and 614.

In some embodiments, providing the sole plate with the features and functions described comprises block 704, molding the sole plate by compression molding or injection molding. For example, the sole plate 10, 110, 210, 310, 410,

510, 610 may be a material that can be molded by one of these processes, such as fiberglass, nylon, or a polyether block amide.

Figure 22:
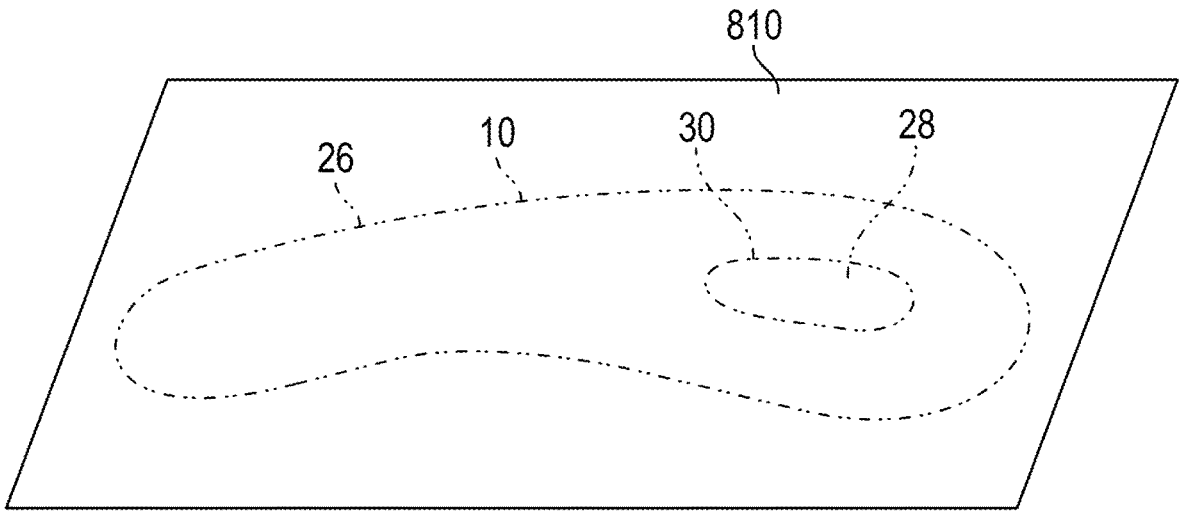
FIG. 22 is a schematic illustration in perspective view of a sheet of material with an outline of a sole plate shown in phantom indicating where a sole plate will be stamped in from the sheet.

As an alternative to molding the sole plate, the method 700 may include block 706, providing the sole plate by stamping the sole plate from a sheet of a material larger than the sole plate. For example, with reference to FIG. 22, a sole plate 10 made of spring steel may be manufactured by stamping the sole plate 10 from a sheet 810 of spring steel material that is larger than the sole plate. The stamping may provide the at least one opening 28 in the sole plate. In other words, the inner perimeter 30 can be stamped either before, after or at the same time that the outer perimeter 26 is stamped, creating the opening 28.

Figure 23:
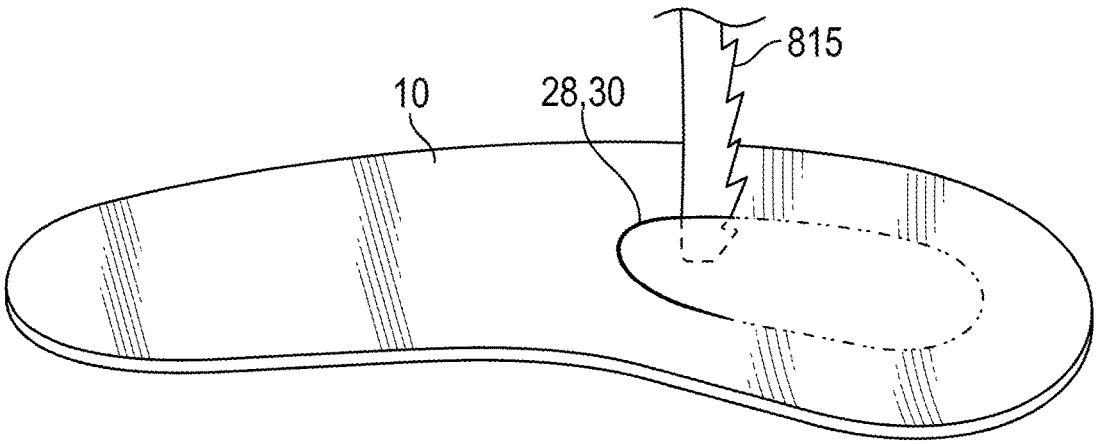
FIG. 23 is a schematic illustration in perspective view of a sole plate with a cutting tool cutting an opening in the sole plate.

Under the method 700, the molding itself can provide the at least one opening. Stated differently, a mold assembly can have a mold cavity that defines the opening. Similarly, if the sole plate is stamped in block 706, the stamping itself can create the opening. Alternatively, the method 700 may include block 708, forming the at least one opening in the sole plate by cutting away a portion of the sole plate. For example, the sole plate can be molded in block 704 or stamped in block 706 without an opening, and the sole plate can be cut to form the opening. FIG. 23 shows a sole plate 10 with a cutting tool 815 cutting the opening 28. The sole plate 10 would be stably supported by clamps or otherwise during the cutting process. If the sole plate 10 is customized for a specific wearer, cutting away a portion of the sole plate 10 to provide the opening 28 would allow a more tailored opening for the wearer than if a mold assembly is used, as the cost of a mold assembly is more suited for use in molding large quantities of sole plates with openings of pre-set dimensions than a custom-sized opening.

A sole plate provided with the features described with respect to block 702 may be secured to a sole layer in block 710, such as to a heel portion or a midfoot portion of an overlying sole layer 42 as described with respect to FIG. 10. Additionally, the sole plate can be secured to a footwear upper in block 712 of the method 700, such as if the sole plate includes the flange 650 of FIG. 19 which can be secured to footwear upper 44. An outsole such as outsole 48 can be secured to the lower side 22 of the sole plate 10 in block 714 of the method. The outsole can include a plate that underlies the sole plate 10 but not the opening 28, or the outsole could be simply tread elements such as cleats 49 secured directly to the lower side 22 of the sole plate 10.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., may be used descriptively relative to the figures, without representing limitations on the scope of the invention, as defined by the claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

What is claimed is:

1. A sole plate for an article of footwear comprising:

a plate body having a lower side, an upper side, an outer perimeter, at least one opening extending through the plate body from the lower side to the upper side, and an inner perimeter bounding the at least one opening;

a sole layer overlying the upper side the plate body; wherein:

the plate body is biased to a first orientation in which the inner perimeter is entirely above the outer perimeter and the upper side of the plate body is spaced apart from a lower side of the sole layer between the inner perimeter and the outer perimeter in a transverse direction of the plate body;

the plate body inverts at the inner perimeter relative to the outer perimeter under a dynamic load applied to the upper side so that the upper side of the plate body abuts the lower side of the sole layer between the inner perimeter and the outer perimeter in the transverse direction of the plate body; and the plate body resiliently returns to the first orientation upon removal of the dynamic load.

2. The sole plate of claim 1, wherein:

the lower side is concave in the first orientation; and the lower side is convex under the dynamic load.

3. The sole plate of claim 1, wherein the plate body slopes in a first direction from the outer perimeter to the inner perimeter in the first orientation, and the plate body slopes in a second direction opposite from the first direction from the outer perimeter to the inner perimeter under the dynamic load.

4. The sole plate of claim 1, wherein the at least one opening comprises a plurality of openings.

5. The sole plate of claim 1, wherein the at least one opening is a single opening.

6. The sole plate of claim 1, wherein:

the plate body includes a continuous band extending from a medial side of the plate body to a lateral side of the plate body;

the outer perimeter is an outer edge of the continuous band; and the inner perimeter is an inner edge of the continuous band.

7. The sole plate of claim 1, wherein:

the outer perimeter extends from a medial side of the plate body to a lateral side of the plate body; and the lower side of the plate body has an asymmetrical concave curvature with an apex that is offset toward the lateral side or the medial side.

8. The sole plate of claim 1, wherein:

the plate body has a forefoot region, a heel region, and a midfoot region disposed between the forefoot region and the heel region;

the at least one opening is in the forefoot region; and the heel region of the plate body includes a flange extending from a medial side of the plate body to a lateral side of the plate body.

9. A sole structure for an article of footwear comprising:

a sole plate having a forefoot region, a lower side, an upper side, an outer perimeter, at least one opening extending through the sole plate from the lower side to the upper side in the forefoot region, and an inner perimeter bounding the at least one opening; wherein the sole plate is a continuous closed structure from the inner perimeter to the outer perimeter and is biased to a first orientation in which the inner perimeter is raised entirely above the outer perimeter;

a sole layer overlying the upper side of the sole plate; wherein the upper side of the sole plate is spaced apart from a lower side of the sole layer between the inner perimeter and the outer perimeter in a transverse direction of the sole plate in the first orientation;

wherein the sole layer transmits an applied dynamic load to the upper side of the sole plate, resiliently deforming the sole plate to a second orientation in which the inner perimeter is below the outer perimeter under the dynamic load and the upper side of the sole plate abuts the lower side of the sole layer between the inner perimeter and the outer perimeter in the transverse direction of the sole plate; and wherein the sole plate resiliently returns to the first orientation upon removal of the dynamic load.

10. The sole structure of claim 9, wherein:

the sole layer has a forefoot region, a heel region, and a midfoot region disposed between the forefoot region of the sole layer and the heel region of the sole layer; and the sole plate and the sole layer are fixed to one another in at least one of the heel region of the sole layer and the midfoot region of the sole layer, and the forefoot region of the sole layer is moveable relative to the forefoot region of the sole plate.

11. The sole structure of claim 10, wherein:

the sole plate has a heel region, and a midfoot region disposed between the forefoot region of the sole plate and the heel region of the sole plate; and the heel region of the sole plate includes a flange extending upward at a rear of the sole plate from a medial side of the sole plate to a lateral side of the sole plate.

12. The sole structure of claim 11 in combination with a footwear upper; wherein the flange is secured to the footwear upper.

13. The sole structure of claim 9, wherein:

the sole plate slopes upward from the outer perimeter to the inner perimeter in the first orientation, and slopes downward from the outer perimeter to the inner perimeter in the second orientation when under the dynamic load.

14. The sole structure of claim 9, wherein:

the outer perimeter extends around a front of the sole plate from a medial side of the sole plate to a lateral side of the sole plate; and the lower side of the sole plate has an asymmetrical concave curvature with an apex that is transversely offset toward the lateral side or the medial side.

15. The sole structure of claim 9, wherein:

the sole plate has a continuous band extending along a front of the sole plate from a medial side of the sole plate to a lateral side of the sole plate in the forefoot region;

the outer perimeter is an outer edge of the continuous band; and the inner perimeter is an inner edge of the continuous band.

16. The sole structure of claim 9, wherein:

the lower side of the sole plate is concave in the forefoot region in a transverse direction of the sole plate in the first orientation; and the lower side of the sole plate is convex in the forefoot region in the transverse direction under the dynamic load.

17. An article of footwear comprising:

a sole plate having a lower side, an upper side, an outer perimeter, at least one opening extending through the sole plate from the lower side to the upper side, and an inner perimeter bounding the at least one opening; wherein the sole plate is biased to a first orientation in which the inner perimeter is raised entirely above the outer perimeter;

a sole layer overlying the upper side of the sole plate and having a foot-facing surface; wherein the upper side of the sole plate is spaced apart from a lower side of the sole layer between the inner perimeter and the outer perimeter in a transverse direction of the sole plate in the first orientation;

a footwear upper secured to the sole layer to secure a foot in position above the foot-facing surface;

wherein the sole layer transmits a dynamic load applied on the foot-facing surface to the upper side of the sole plate, resiliently deforming the sole plate to a second orientation in which the inner perimeter displaces to below the outer perimeter under the dynamic load and the upper side of the sole plate abuts the lower side of the sole layer between the inner perimeter and the outer perimeter in the transverse direction of the sole plate; and wherein the sole plate resiliently returns to the first orientation upon removal of the dynamic load.

18. The article of footwear of claim 17, wherein:

the sole layer has a forefoot region, a heel region, and a midfoot region disposed between the forefoot region of the sole layer and the heel region of the sole layer;

the at least one opening is in the forefoot region;

the sole plate and the sole layer are fixed to one another in at least one of the heel region of the sole layer and the midfoot region of the sole layer; and the forefoot region of the sole layer is moveable relative to the forefoot region of the sole plate.

19. The article of footwear of claim 17, wherein:

the sole plate has a forefoot region, a heel region, and a midfoot region disposed between the forefoot region of the sole plate and the heel region of the sole plate;

the heel region of the sole plate includes a flange extending upward at a rear of the sole plate from a medial side of the sole plate to a lateral side of the sole plate; and the flange is secured to the footwear upper.

* * * * *